US009649778B2

(12) United States Patent
Matys

(10) Patent No.: US 9,649,778 B2
(45) Date of Patent: May 16, 2017

(54) METHOD AND MOLD FOR MANUFACTURING AN INTERLOCKING CONCRETE BLOCK

(71) Applicant: Angelo Risi, Thornhill (CA)

(72) Inventor: Tyler Matys, Thornhill (CA)

( * ) Notice: Subject to any disclaimer, the term of this patent is extended or adjusted under 35 U.S.C. 154(b) by 650 days.

(21) Appl. No.: 14/093,710

(22) Filed: Dec. 2, 2013

(65) Prior Publication Data

US 2015/0151450 A1 Jun. 4, 2015

(51) Int. Cl.

| | |
|---|---|
| ***B28B 3/02*** | (2006.01) |
| ***B28B 7/00*** | (2006.01) |
| ***B28B 7/20*** | (2006.01) |
| ***B28B 7/24*** | (2006.01) |
| ***B28B 7/28*** | (2006.01) |

(52) U.S. Cl.
CPC ..... *B28B 7/0079* (2013.01); *B28B 7/0097* (2013.01); *B28B 7/20* (2013.01); *B28B 7/24* (2013.01); *B28B 7/285* (2013.01)

(58) Field of Classification Search
CPC ..... B28B 3/021; B28B 7/0079; B28B 7/24
See application file for complete search history.

(56) References Cited

U.S. PATENT DOCUMENTS 4,023,767 A * 5/1977 Fontana ..... B28B 7/183 249/119
4,335,549 A * 6/1982 Dean, Jr. ..... B28B 7/183 52/314
4,660,344 A * 4/1987 Gaudelli ..... B28B 7/08 404/7
8,765,044 B2 * 7/2014 Ness ..... B28B 3/021 264/333
2003/0126821 A1 * 7/2003 Scherer ..... B28B 7/007 52/604
2004/0218985 A1 * 11/2004 Klettenberg ..... B28B 3/06 405/284
2008/0258340 A1 * 10/2008 Klettenberg ..... B28B 7/0041 264/293
2008/0277561 A1 * 11/2008 MacDonald ..... B28B 7/24 249/158

* cited by examiner

*Primary Examiner* — James Sanders
(74) *Attorney, Agent, or Firm* — Sughrue Mion, PLLC

(57) ABSTRACT

A mold and method for manufacturing interlocking concrete blocks. The mold comprises a mold box, comprising two side walls joined to end walls to define a mold cavity, a top face, and a substantially open bottom face. Top insert members are configured to define a space between adjacent blocks, for forming a portion of the transverse profile of the top surface of one block or a portion of the transverse profile of the bottom surface of an adjacent block, or both. A removable draw plate for closing the bottom of the mold box comprises a generally planar floor and bottom insert members configured to define a space between adjacent blocks, for forming a remaining portion of the transverse profile of the top surface of one block or a remaining portion of the transverse profile of the bottom surface of an adjacent block, or both.

7 Claims, 29 Drawing Sheets

Section A-A

Section A-A

Section B-B

METHOD AND MOLD FOR MANUFACTURING AN INTERLOCKING CONCRETE BLOCK

FIELD OF THE INVENTION

This invention relates to prefabricated interlocking concrete blocks.

BACKGROUND OF THE INVENTION

Interlocking concrete blocks are used for many outdoor construction applications, one of the most common being the construction of retaining walls. Interlocking concrete blocks are thus designed for durability, stability and aesthetic appeal.

One of the ways that aesthetic appeal is imparted to a structure formed from interlocking concrete blocks is to make the exposed face look as much as possible like natural stone. Conventionally this is accomplished by casting concrete blocks in a mold, with the exposed face of one block joined to the exposed face of another block, and breaking the blocks apart along a score line. This results in an essentially random topography on each exposed face of the block pair, which produces a natural 'look and feel'. An example of a conventionally-formed interlocking concrete block is illustrated in FIG. 1L.

For example, FIGS. 1A to 1L illustrate a typical molding process for a prior art interlocking concrete block 20. FIG. 1A shows a prior art mold 10 with a mold box 12 and a floor comprising a draw plate 14 in position for casting. The draw plate 14 has a profile with projecting features 5*a* designed to form the interlocking structures on the bottom of the block 20 (in the embodiment shown recesses 5) and projecting features 6*a* forming break lines 6, as shown in FIG. 1B. After dry mix concrete has been fed into the mold 10, shown in FIG. 1C, a press head 15 is actuated to consolidate the concrete 1. In the prior art blocks 20 shown the press head 15 also forms the top interlocking structures, ribs or "tongues" 4 complementary to the recesses 5, and break lines 6, as shown in FIG. 1C.

The steps in the prior art forming process are illustrated in FIGS. 1D to 1L. The mold box 12 is positioned (FIG. 1D) beneath the press head 15 and the mold box 12 is placed on the draw plate 14 (FIG. 1E). Concrete 1 is fed into the mold 10 (FIG. 1F) and the press head 15 is actuated to consolidate the concrete and form the top surface 22 of the block 20 (FIG. 1G), then the press head 15 is retracted (FIG. 1H). The draw plate 14 can be removed immediately due to the zero slump concrete mix and the consolidation by the press head (FIG. 1I), and the mold box 12 lifted off of the slab of joined blocks 20 (FIG. 1J), leaving the unbroken slab of blocks 20 on a board or pallet (not shown). After the concrete has cured for at least 12 hours, blades 7 are forcibly applied to the break lines to split the individual blocks 20 from the slab (FIG. 1K). The exposed faces of the blocks 20 manufactured in this fashion have a "split block" finish, shown in FIG. 1L, which has been an industry standard for over 25 years.

There are disadvantages to this manufacturing method. While the (complementary) topographies produced on the exposed faces by breaking the blocks apart looks natural, using this manufacturing method the manufacturer has no control over the final appearance of the exposed face of the block because the fracturing occurs randomly. This limits the profile of the exposed face, and occasionally blocks must be rejected because of over-breakage resulting in the exposed face having a damaged appearance. Also, the height of the concrete blocks is determined by the stroke of the press head, which is a moving part, and since the length of each stroke of the press head may be slightly different there is a commensurate variation in the heights of concrete blocks cast at different times. Furthermore, if a colour other than natural concrete is desired on the exposed face, the colour must be mixed into the entire volume of concrete so that the exposed face provides a uniform colour, which given the cost of some dyes can be very expensive.

One or more of the embodiments of the invention addresses one or more of these disadvantages. While embodiments of the invention are described in detail below, it will be appreciated that not every advantage of the present invention necessarily applies to every embodiment described or claimed herein.

BRIEF DESCRIPTION OF THE DRAWINGS

In drawings which illustrate an embodiment of the invention by way of example only.

DETAILED DESCRIPTION OF THE INVENTION

Figure 1A:
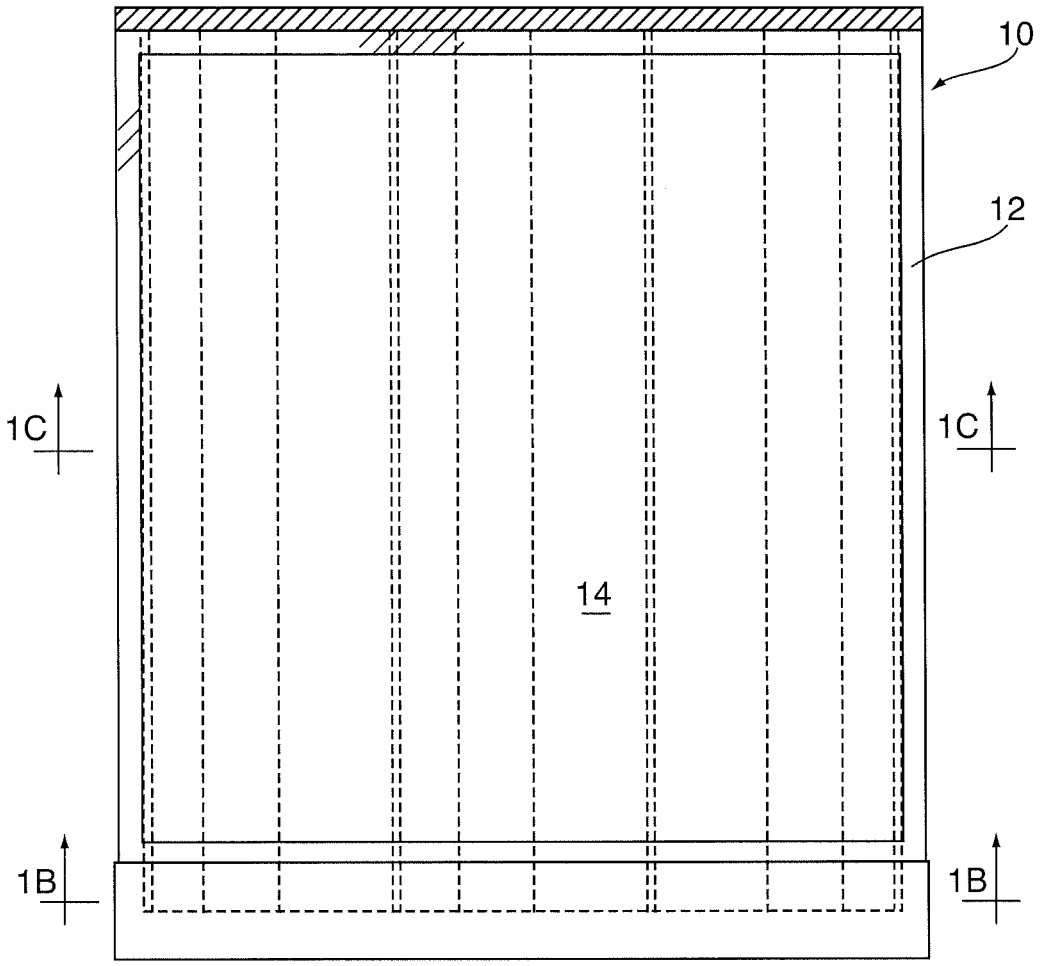
Fig. 1A PRIOR ART
FIGS. 1A to 1L are views showing a typical molding process for a prior art interlocking concrete block.
Figure 1B:
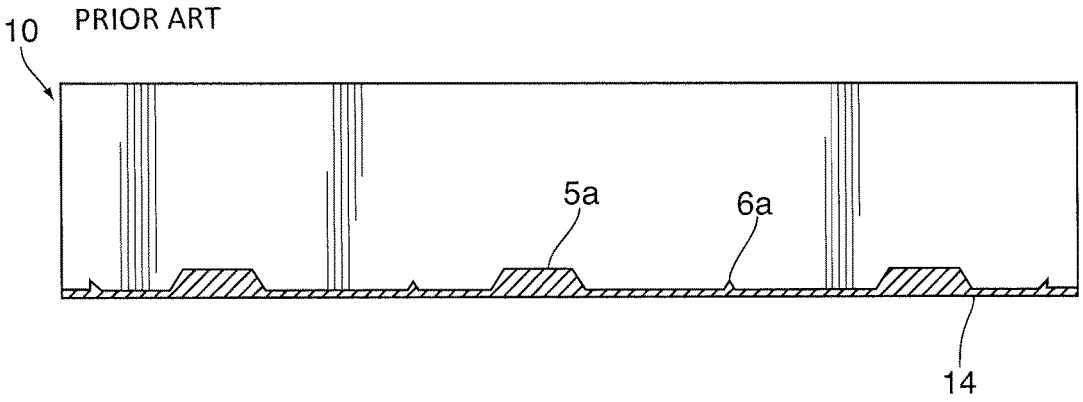
Fig. 1B PRIOR ART
Figure 1C:
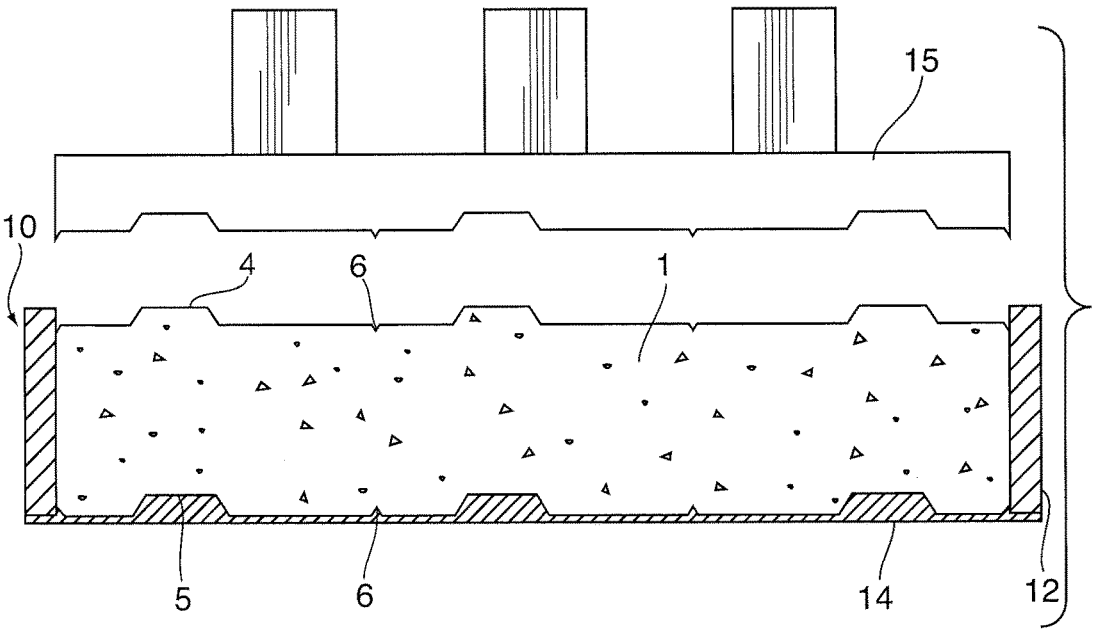
Fig. 1C PRIOR ART
Figure 1D:
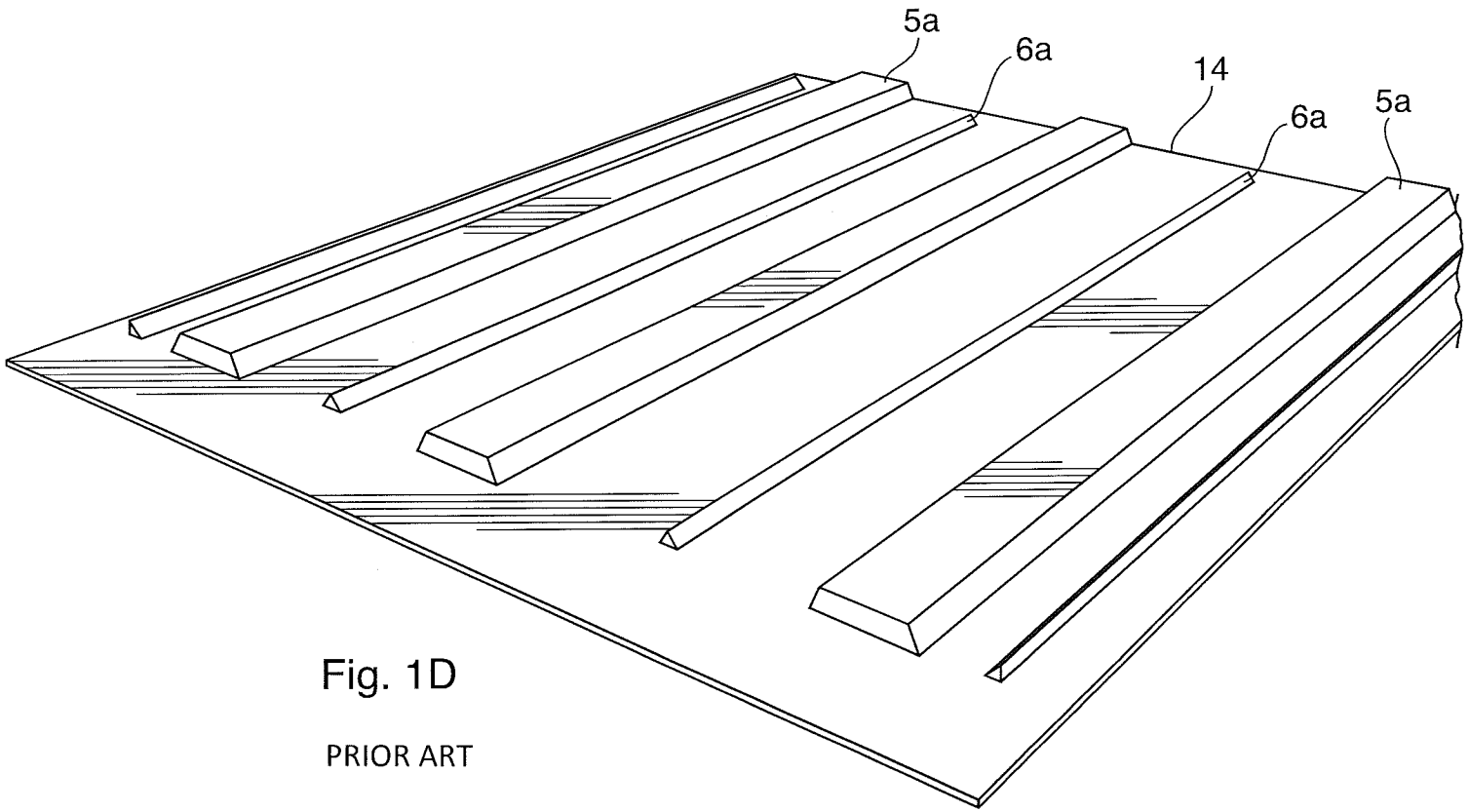
Fig. 1D PRIOR ART
Figure 1E:
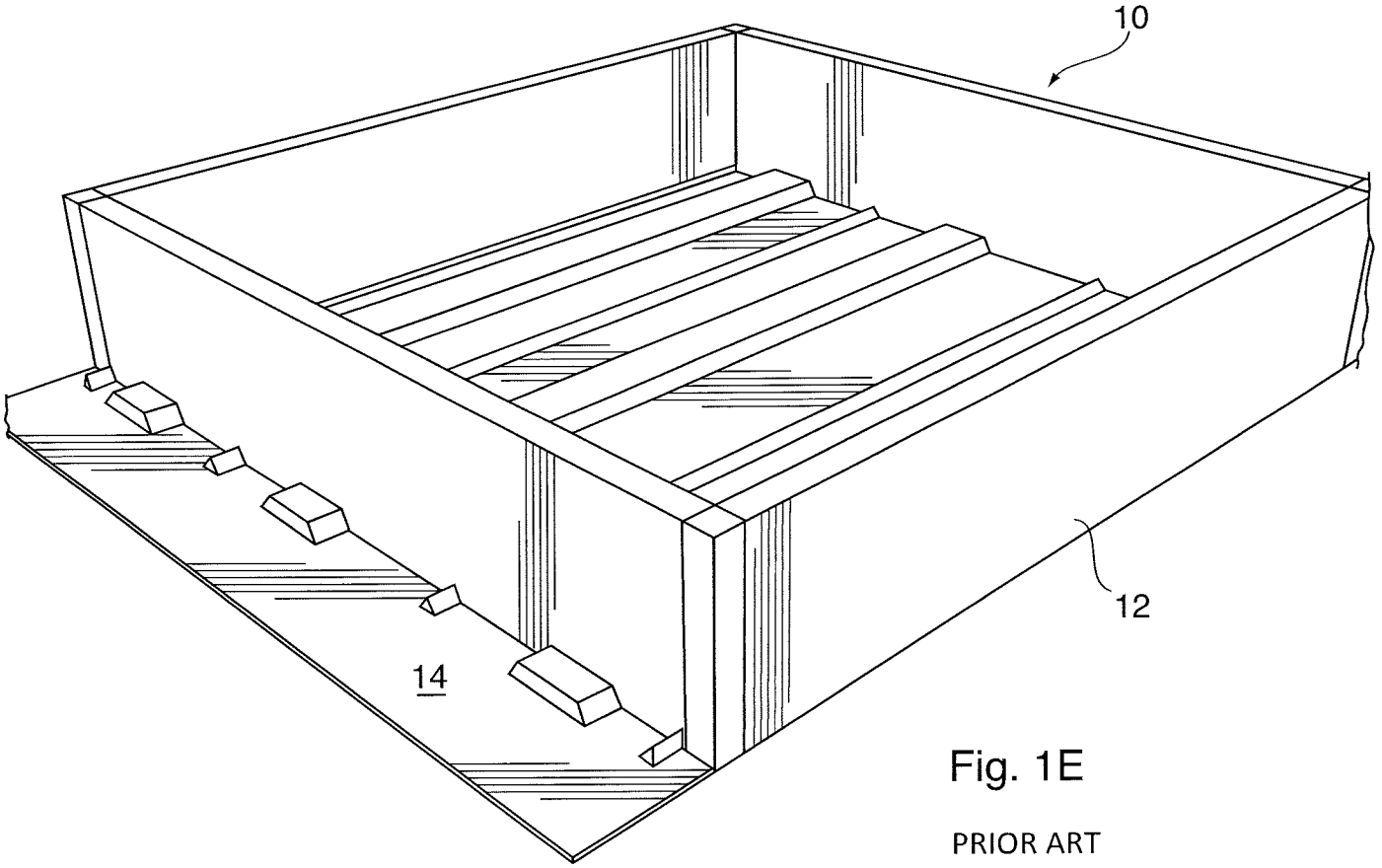
Fig. 1E PRIOR ART
Figure 1F:
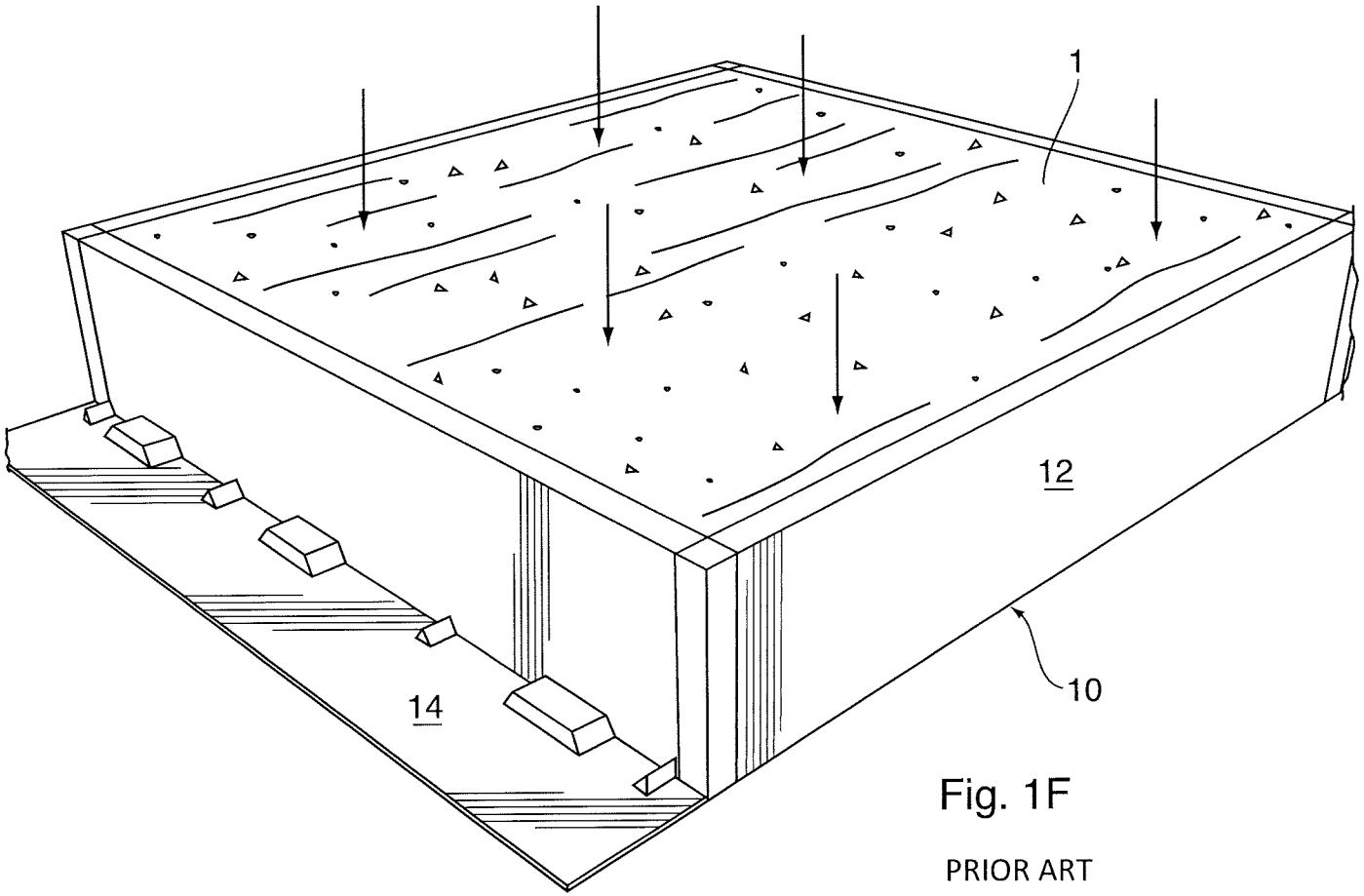
Fig. 1F PRIOR ART
Figure 1G:
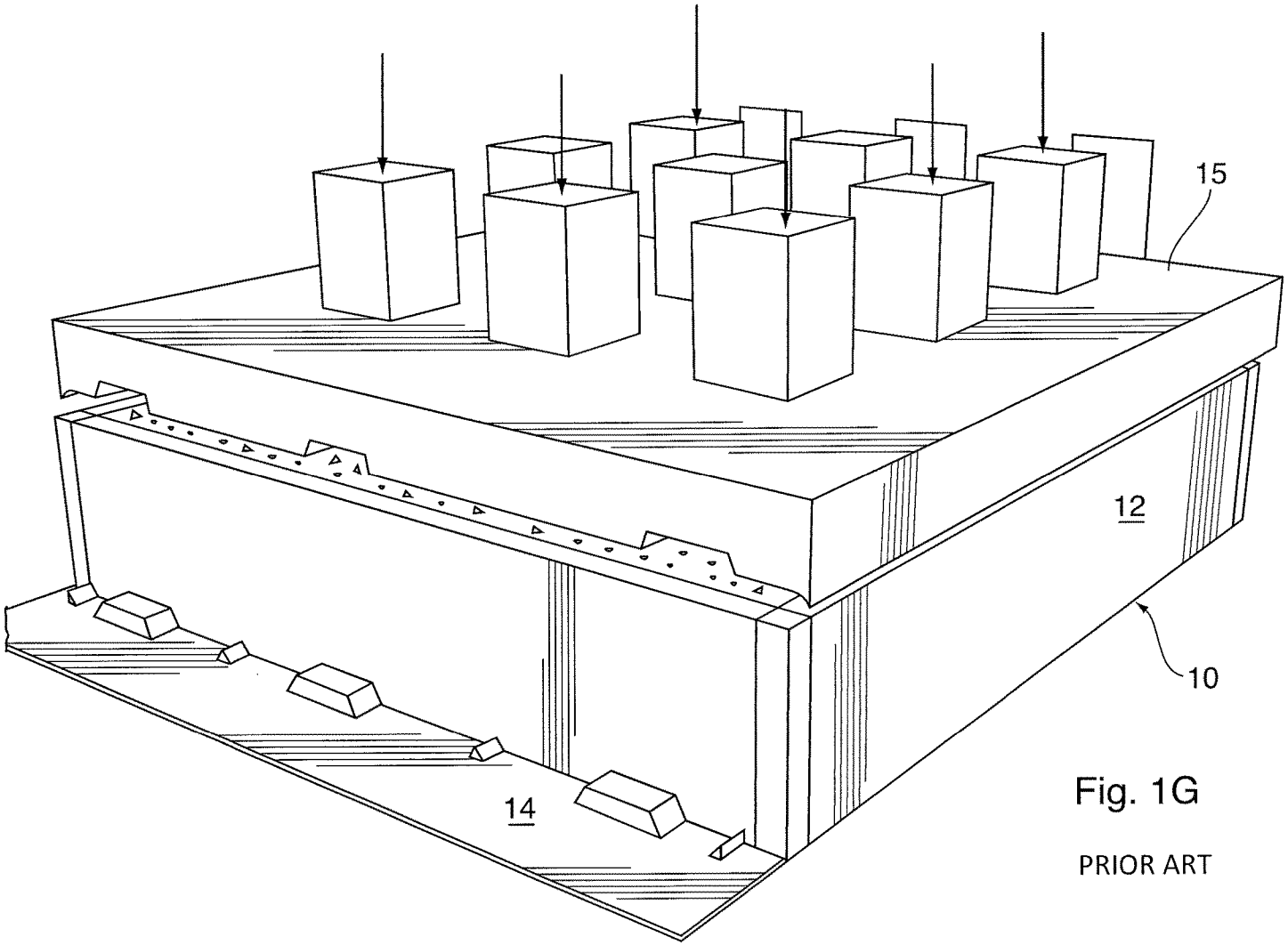
Fig. 1G PRIOR ART
Figure 1H:
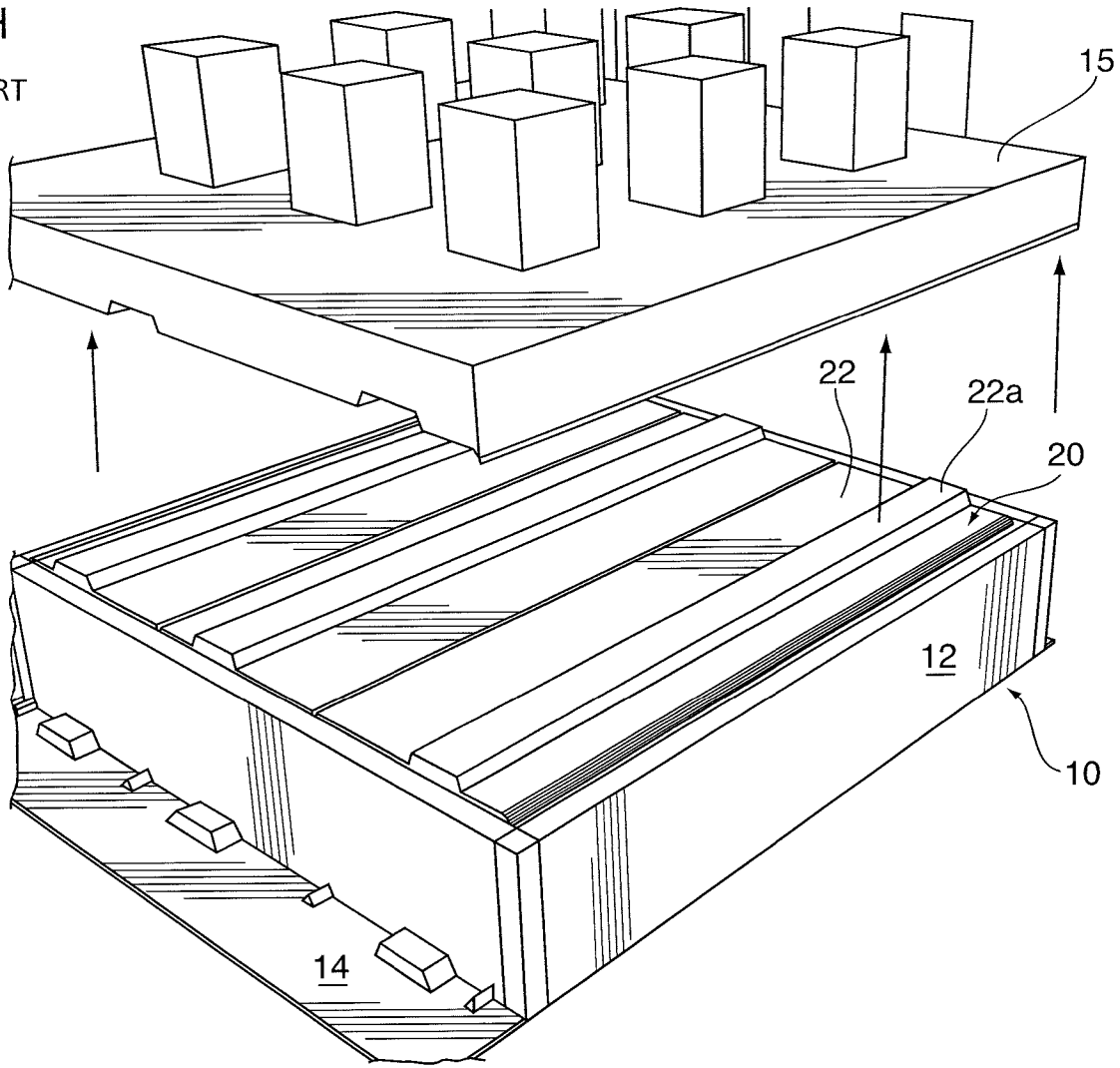
Fig. 1H PRIOR ART
Figure 1I:
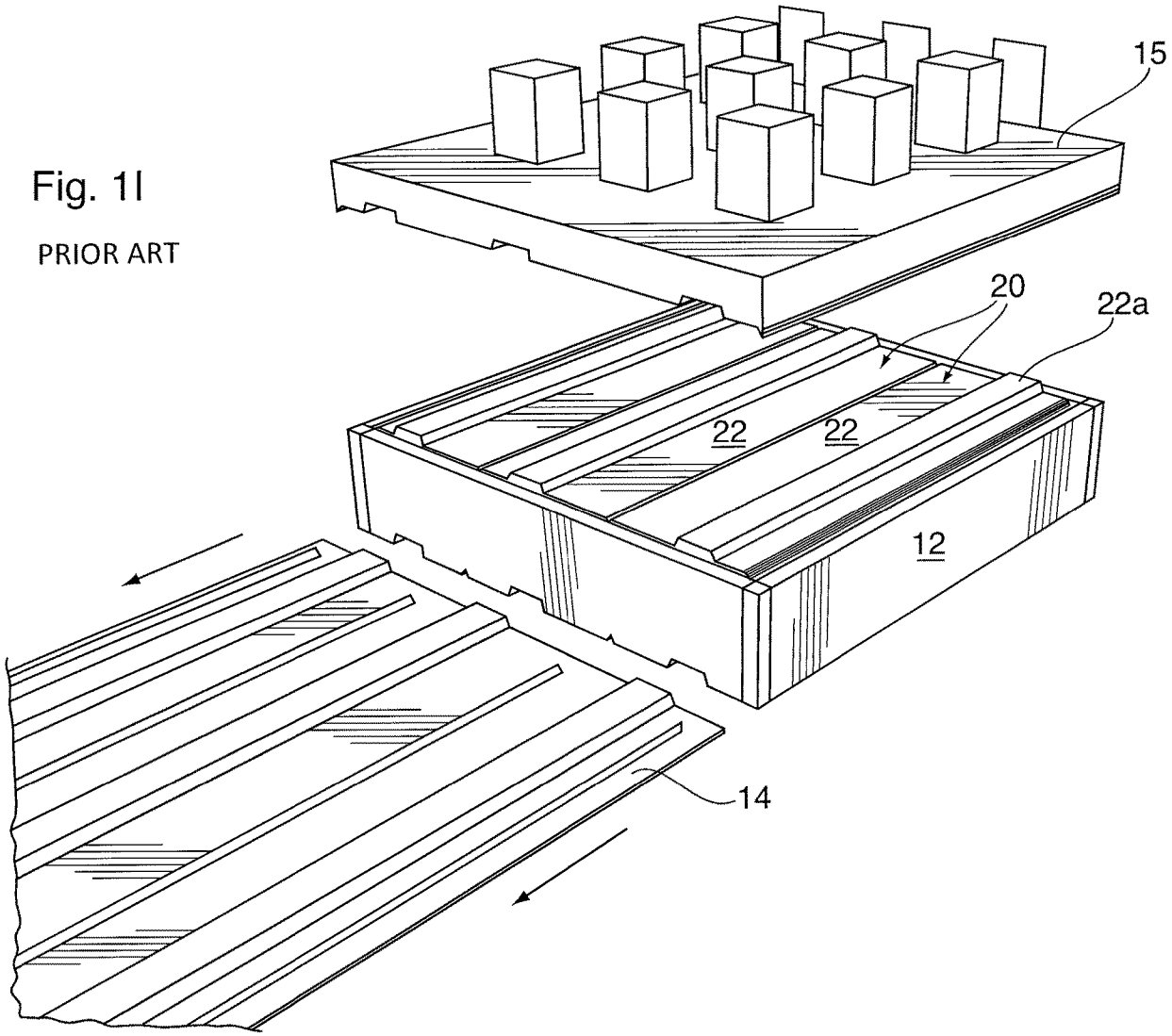
Fig. 1I PRIOR ART
Figure 1J:
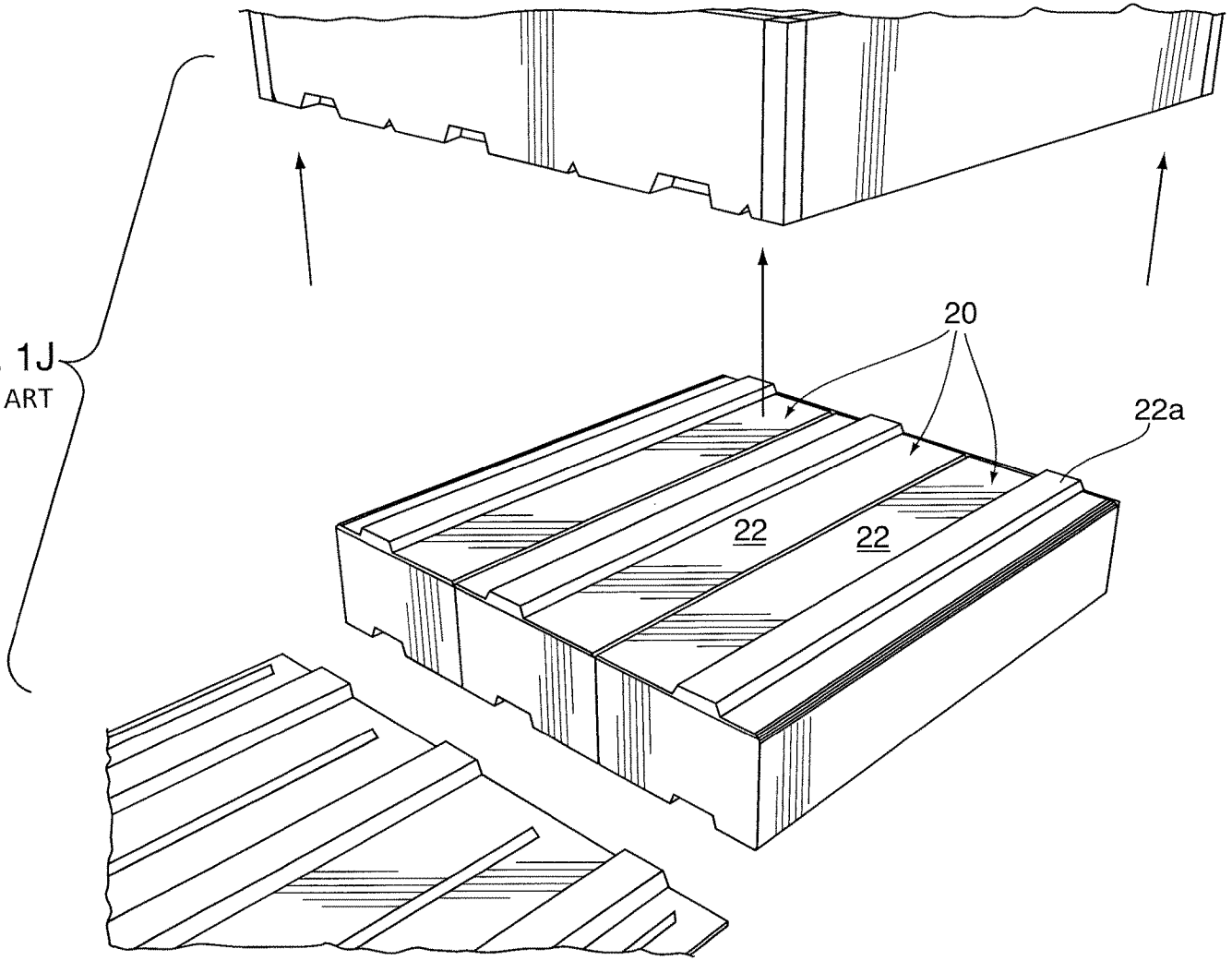
Fig. 1J PRIOR ART
Figure 1K:
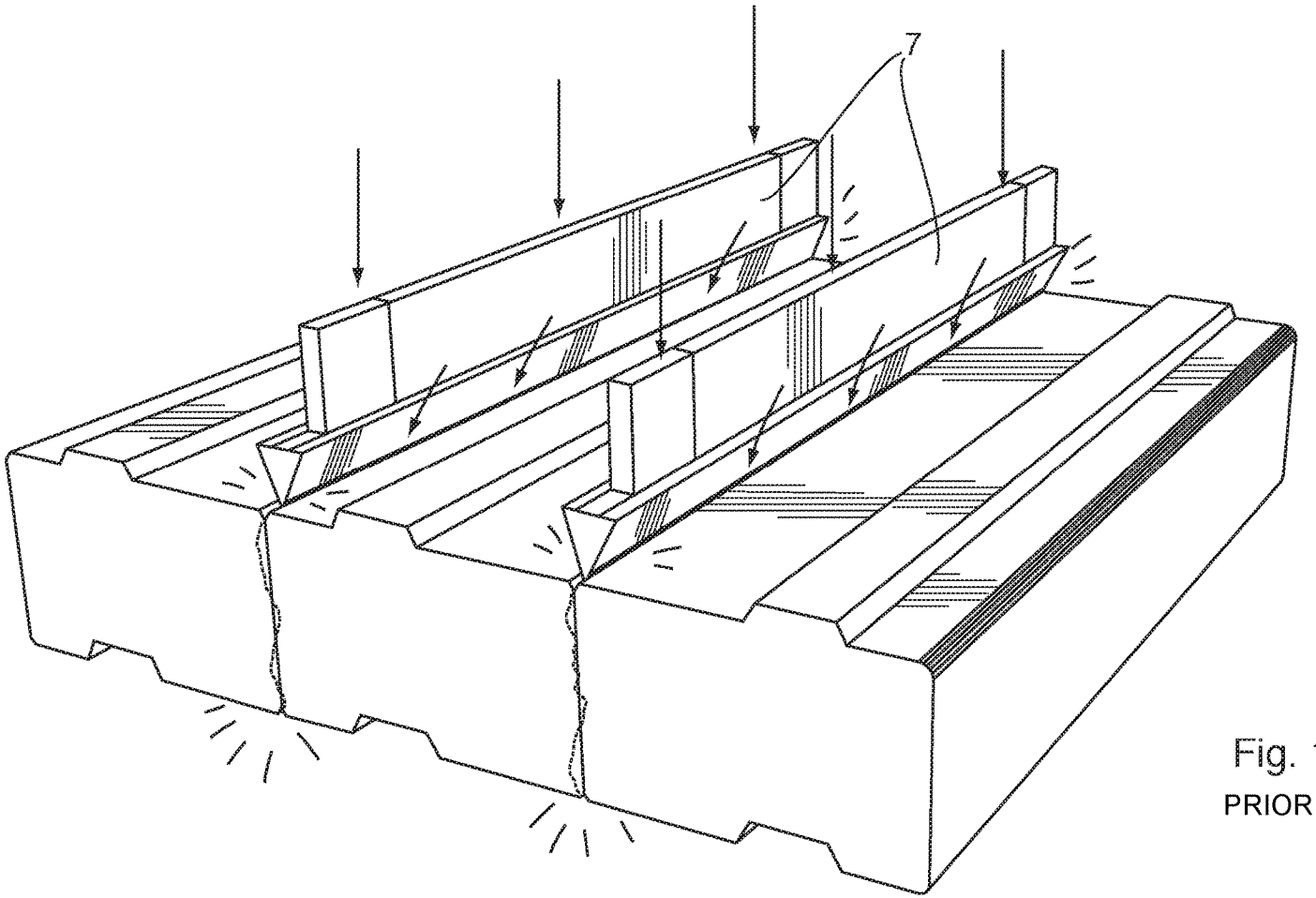
Fig. 1K PRIOR ART
Figure 1L:
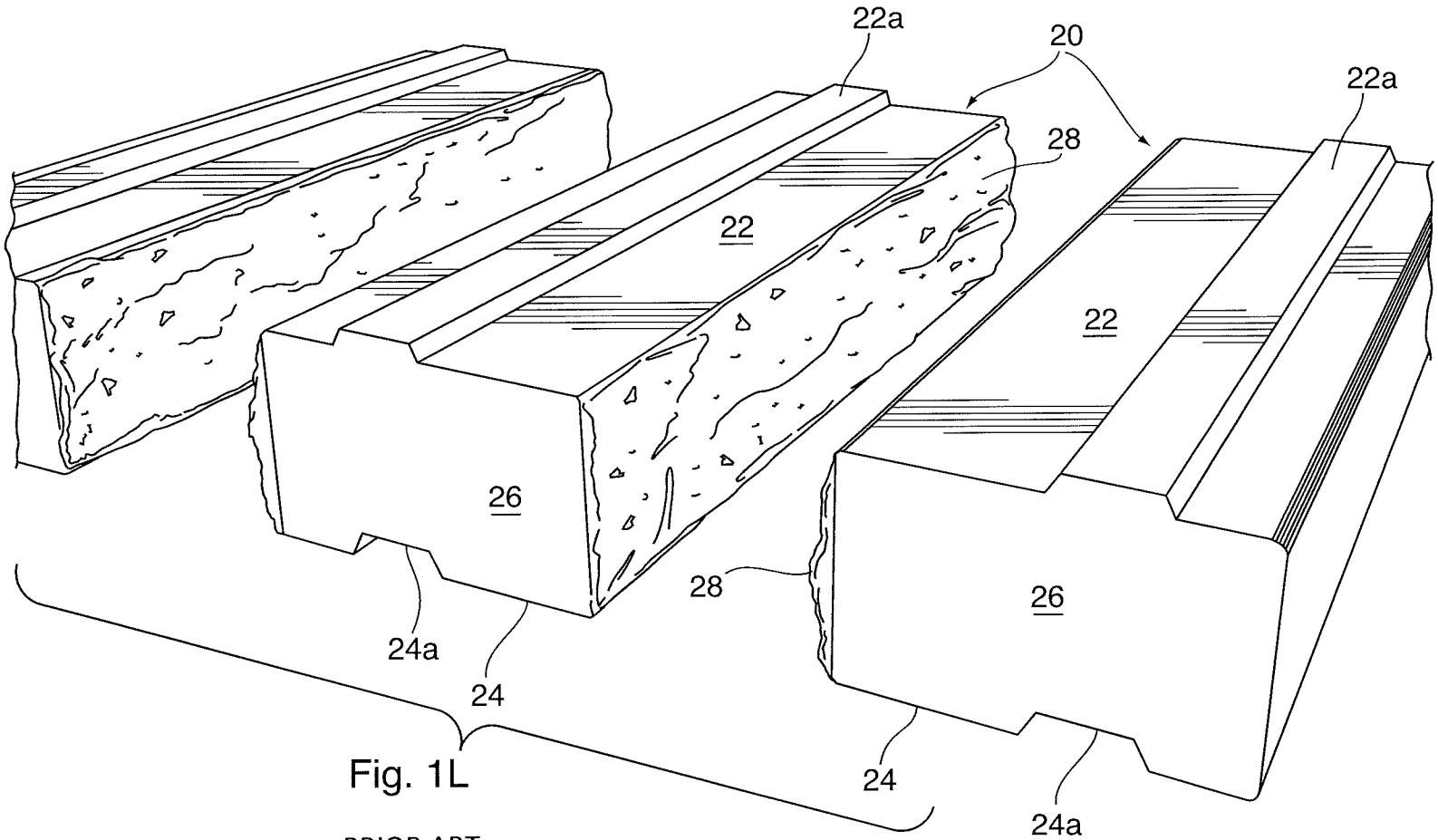
Fig. 1L PRIOR ART
Figure 2:
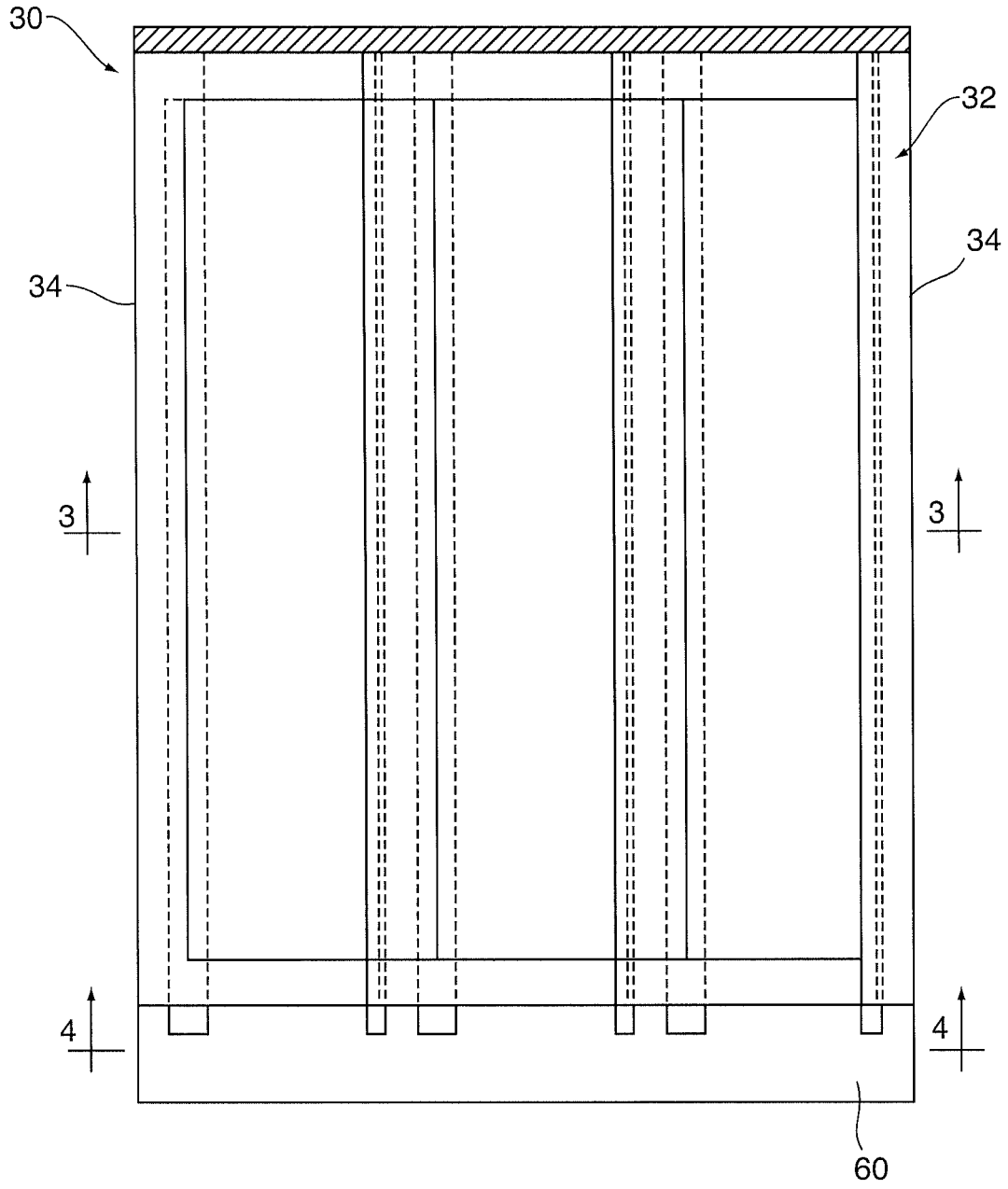
FIG. 2 is a plan view of a mold according to the invention.

The present invention provides a mold for and method of manufacturing an interlocking concrete block 20 which has an exposed face to which fully controllable custom textures and profiles can be applied with a press head, in some embodiments without removing the blocks 20 from the mold box. The exposed faces of the blocks 20 can also be coloured as desired, using a minimal amount of expensive concrete pigment in a face coat which can be as little as 10-15 mm thick. The height tolerance of each block 20 is determined by sturdy, fixed structures within the mold itself, rather than by a moving press head as in the prior art technique described above, and is therefore perfect so each block is substantially identical in height with all other blocks cast in the same mold. This is a major benefit for ease of installation compared to prior art systems. By changing the orientation of the blocks 20 within the mold, particularly with the exposed face 28 facing upwardly, the potential for changing the aesthetics of the exposed block face 28 is significantly increased. In order to do this, two main technological advances over the prior art have been employed:

1. The draw plate 14 has historically played a minor role in the formation of the block shape, mainly limited to small or shallow grooves, such as a keyway or a chamfer as shown in FIGS. 1D and 1L. According to the invention, the draw plate becomes an important component in the formation of both the positive and negative structures of the block 20. As such the draw plate should be manufactured with increased robustness, stiffness, and strength, and so as to accommodate the "undercut" shape as it passes through the end wall of the mold, as described below. The draw plate design provides large, vertical structural elements for this purpose, which have never been used in this type of mold.
2. The invention represents the first concrete block mold to have the mold box and the draw plate combine to form a single structural element of the block 20, such as the upper tongue 22*a*. In the prior art, the top surface 22 of the block 20 is created with the press head 15, which includes a negative of the entire tongue 22*a*. The bottom surface 24 of the block 20, which would include minor grooves or chamfers, is created by the draw plate 14. According to the invention, inserts within the mold box and vertical projections from the draw plate meet to form both the upper tongue 22*a* and the complementary lower groove 24*a*. The mold box and draw plate combine to form each of the top surface 22 of the block 20 and the bottom surface 24 of the block 20, which has never been done in this type of mold.

The invention accomplishes this by providing, in the preferred embodiment, a mold 30 in which the interlocking concrete blocks are cast in an orientation such that their exposed faces 28 are at the top of the mold 30. The blocks 20 are thus oriented such that the top surface 22 of one block 20 is adjacent to the bottom surface 24 of the block 20 beside it (or the wall 34 of the mold box 32). The mold box 32 for a typical block configuration is thus deeper than a prior art mold box 12, but commensurately smaller side-to-side so the footprint required for the casting process is reduced. Thus, interlocking concrete blocks 20 can be manufactured according to the method of the invention with a higher throughput for the same amount of floor space.

As noted above, providing the exposed faces 28 of the interlocking concrete blocks 20 at the top of the mold 30 also allows for the application of a surface coat of face mix or another suitable, durable coating material to be applied while the blocks 20 are still in the mold 30. The exposed faces 28 may be coloured as desired without having to colour the concrete used for the body of the interlocking concrete block 20, and/or formed to any desired texture or profile.

The invention thus provides a mold for manufacturing at least one interlocking concrete block, the at least one block having a top surface having a transverse profile comprising at least one interlocking structure projecting from or recessed into the top surface, and a bottom surface having a transverse profile comprising at least one complementary interlocking structure projecting from or recessed into the bottom surface, the mold comprising a mold box, comprising two side walls joined to end walls to define a mold cavity, a top face, and a substantially open bottom face, and top insert members configured to define a space between adjacent blocks or a space between a block and a side of the mold box, extending between the end walls of the box substantially from the top face into the mold cavity, for forming a portion of the transverse profile of the top surface of one block or a portion of the transverse profile of the bottom surface of an adjacent block or both, and a removable draw plate for closing the bottom of the mold box, comprising a generally planar floor, and bottom insert members configured to define a space between adjacent blocks, or a space between a block and a side of the mold box, extending between the end walls and projecting from the floor into the mold cavity, for forming a remaining portion of the transverse profile of the top surface of one block or a remaining portion of the transverse profile of the bottom surface of an adjacent block, or both.

The invention further provides a method of manufacturing a plurality of interlocking concrete blocks each having a top surface having a transverse profile comprising at least one interlocking structure projecting from or recessed into the top surface and a bottom surface having a transverse profile comprising at least one complementary interlocking structure projecting from or recessed into the bottom surface, in a mold comprising a mold box comprising two side walls joined to end walls to define a mold cavity, a top face, and a substantially open bottom face, top insert members configured to define a space between adjacent blocks or a space between a block and a side of the mold box extending between the end walls of the box substantially from the top face into the mold cavity for forming an upper portion of the transverse profile of the top surface of one block or an upper portion of the transverse profile of the bottom surface of an adjacent block or both, and a draw plate comprising a generally planar floor and bottom insert members configured to define a space between adjacent blocks or a space between a block and a side of the mold box extending between the end walls and projecting from the floor into a mold cavity, for forming a remaining portion of the transverse profile of the top surface of one block or a remaining portion of the transverse profile of the bottom surface of an adjacent block, or both, comprising the steps of: a. fitting the mold box to the draw plate such that the bottom insert members are received into openings in the end walls of the mold box; b. feeding concrete into the mold cavity; c. consolidating the concrete; d. in any order: i. sliding the draw plate out of the mold in a lateral direction; and ii. removing the formed blocks from the mold box.

FIGS. 2 to 11 illustrate a mold 30 for manufacturing a plurality of interlocking concrete blocks 20 according to the invention. The interlocking blocks 20 are of the type having a top surface 22 with a transverse profile comprising at least one interlocking structure projecting from or recessed into the top surface 22, in the embodiment shown a tongue or rib 22*a*, and a bottom surface 24 having a transverse profile comprising at least one complementary interlocking structure projecting from or recessed into the bottom surface 24, in the embodiment shown a groove or recess 24*a* complementary to the tongue 22*a*.

Figure 5:
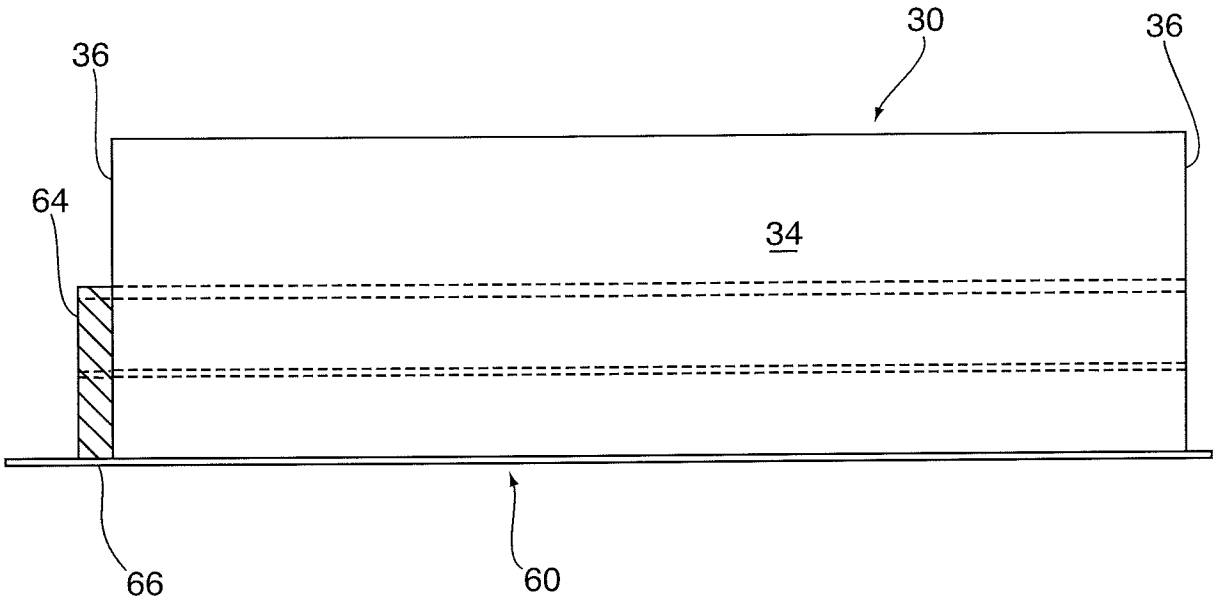
FIG. 5 is a side elevation of the mold of FIG. 2.
Figure 6:
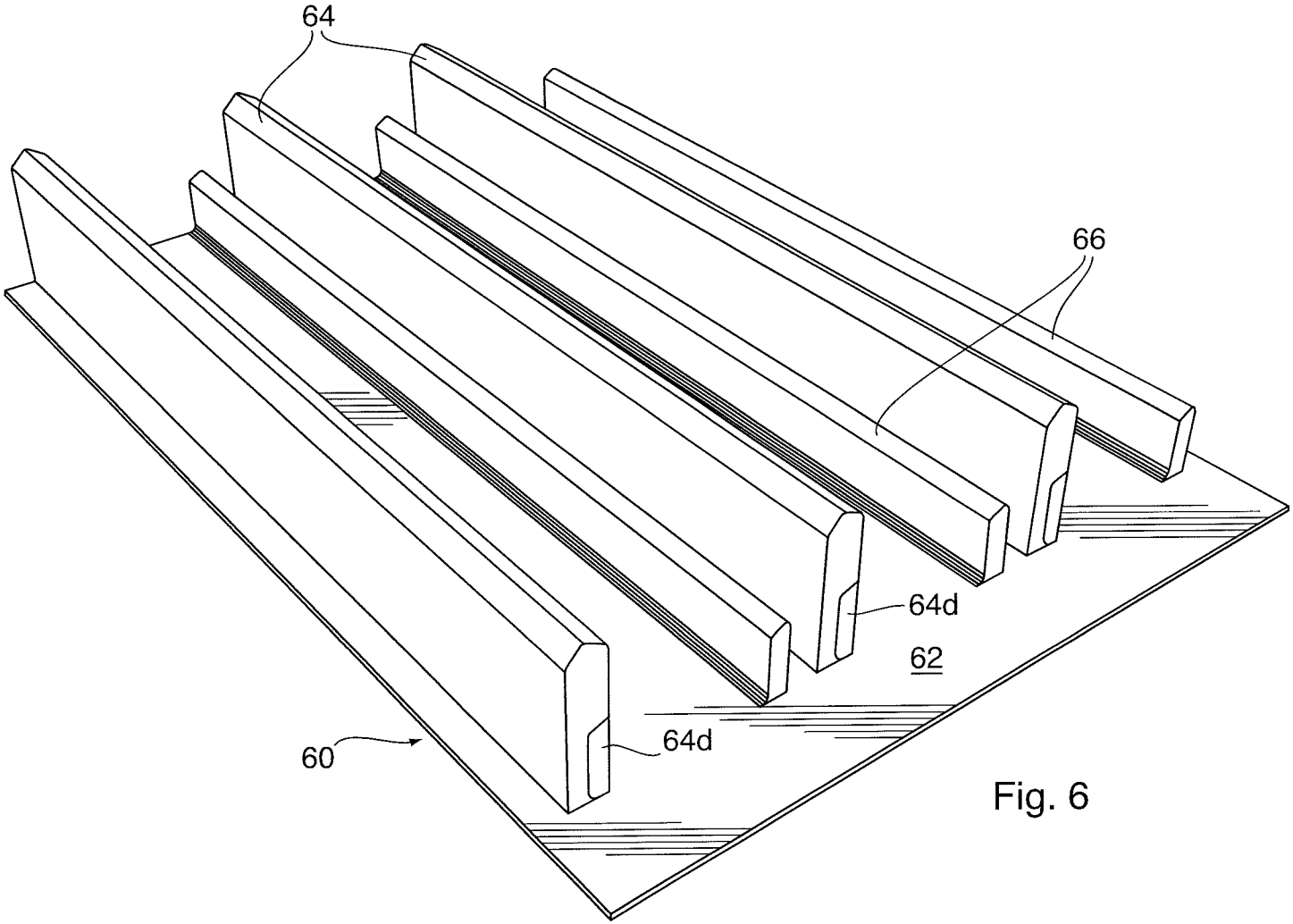
FIG. 6 is a perspective view of the draw plate in the mold of FIG. 2 taken from the front-left.
Figure 7:
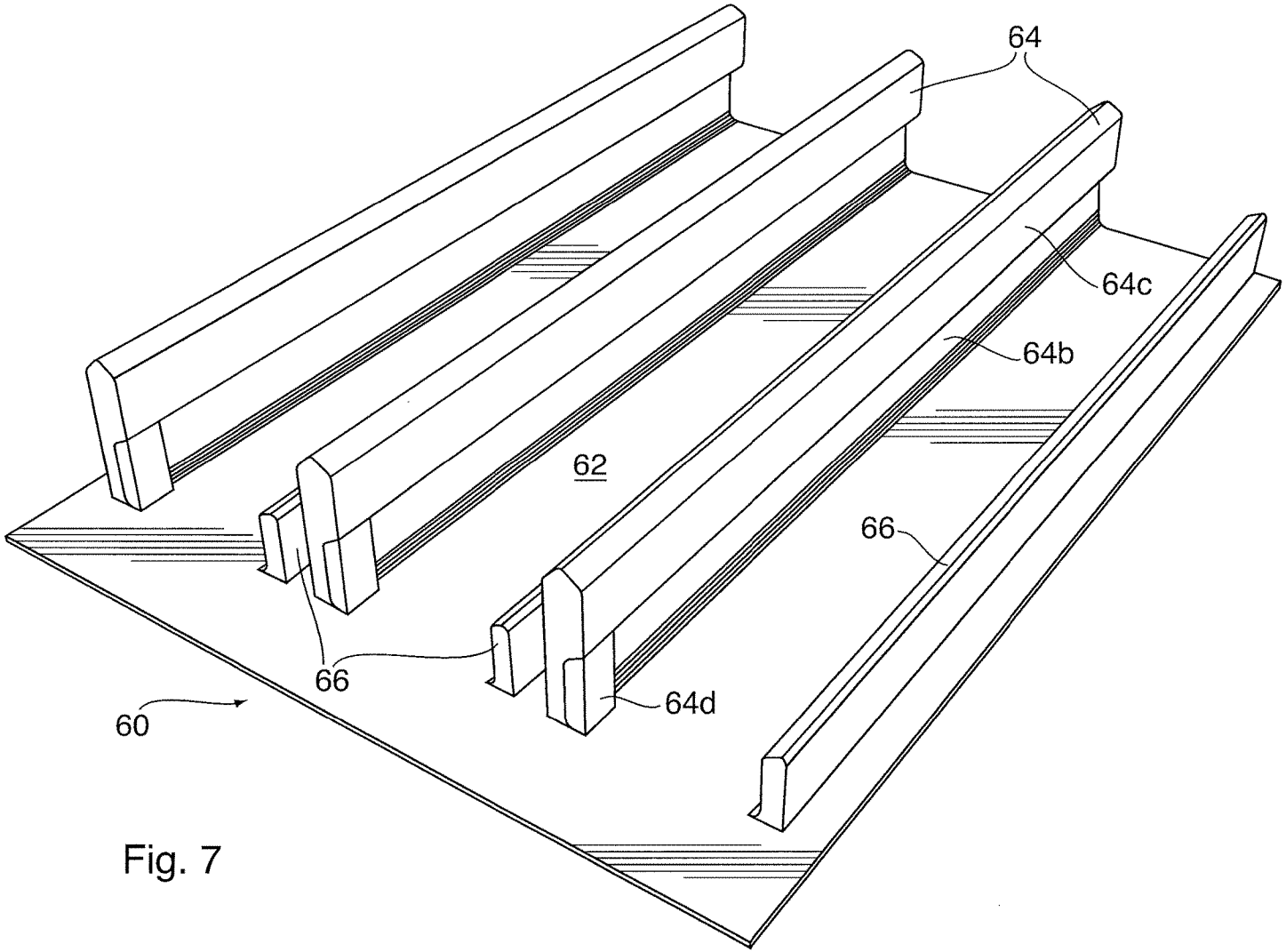
FIG. 7 is a perspective view of the draw plate in the mold of FIG. 2 taken from the front-right.

The projecting rib 22*a* on the top 22 of the block 20 extends laterally (i.e. in the end-to-end direction), and the recess 24*a* complementary to the rib 22*a* also extends laterally, providing a "tongue and groove interlock" which prevents one block 20 from shifting transversely relative to the block 20 immediately above or beneath in the structure, as best seen in FIG. 5. In the embodiment illustrated the interlocking structures 22*a*, 24*a* extend fully between the ends 26 of the block 20, however it will be appreciated that the interlocking structures 22*a*, 24*a* may extend partially between the ends 26 of the block 20. The precise length, height, shape and placement of the interlocking structures 22*a*, 24*a* is a matter of selection and is in no way limited by the particular embodiment illustrated.

In the preferred embodiment of the invention, the blocks 20 are oriented in the mold 30 such that the exposed face 28 of each block 20, defined herein as the face of the block 20 that is intended to be visible in the finished structure (for example a retaining wall), is disposed in a plane generally parallel to the top face 40 of the mold 30, preferably flush with the top of the mold 30.

Figure 10:
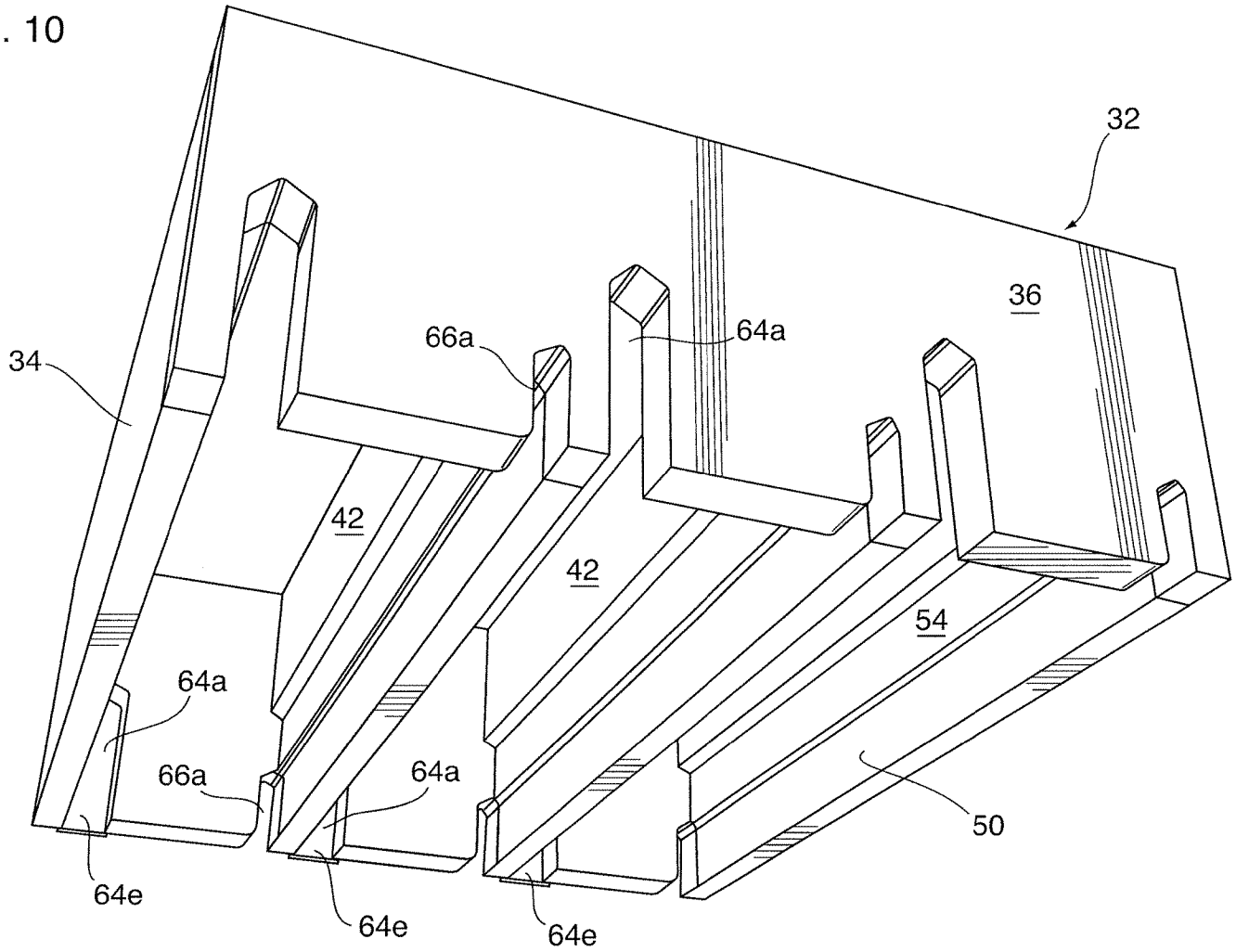
FIG. 10 is a perspective view of the mold box in the mold of FIG. 2 taken from the bottom-left.
Figure 11:
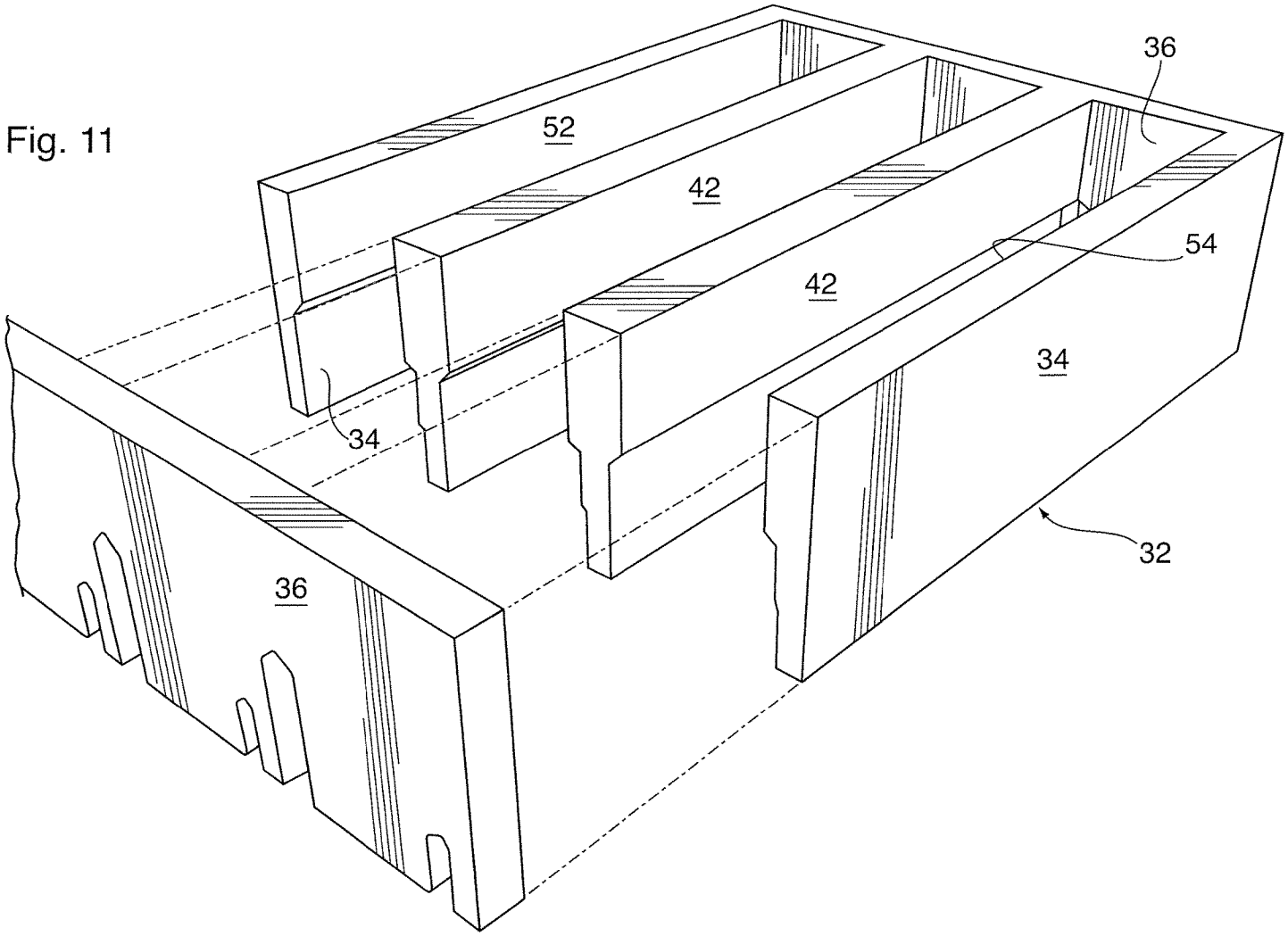
FIG. 11 is an exploded perspective view of the mold box in the mold of FIG. 2.

The mold 30 comprises a mold box 32, comprising two side walls 34 joined to two end walls 36 to define a mold cavity 38. The bottom face 50 of the mold box 32, best seen in FIG. 10, is substantially open. The top face 40 is open between top insert members 42, 52 and 54. As illustrated in FIG. 11, one end wall 36 of the mold box 32 may be formed separately from the remainder of the mold box 32, which allows the mold box 32 to be manufactured by conventional casting techniques. The detached end 36 may be bolted to the remainder of the mold box 32 or affixed by any other suitable means.

Top insert members 42 are configured to define a space between adjacent blocks 20, and top insert members 52, 54 are configured to define a space between blocks 20 disposed at the sides of the mold 30 and the respective side walls 34. Top insert members 42, 52 and 54 extend between the end walls 36 of the mold box 32, substantially from the top face 40 (i.e. generally flush with the top of the mold box 32) into the mold cavity 38.

The top insert members 42 are configured to form an upper portion of the transverse profile of the top surface 22 of one block 20 and an upper portion of the transverse profile of the bottom surface 24 of an adjacent block 20 in the mold 30. The top insert members 42 are accordingly provided on one side 42*a* with a profile that is a 'negative' of the transverse profile of a portion of the bottom surface 24 of the block 20; and on the other side 42*b* with a profile that is a 'negative' of the transverse profile of a portion of the top surface 22 of the block 20. In the embodiment shown, for example, the top insert members 42 are provided on side 42*a* with a profile complementary to the transverse profile of the portion of the bottom surface 24 of the block 20 extending from the exposed face 28 up to but not including the recess 24*a*. The other side 42*b* is provided with a profile complementary to the transverse profile of the portion of the top surface 22 of the block 20 extending from the exposed face 28 up to and including the outermost surface of the rib 22*a*.

To complete these portions of the transverse profiles of the blocks 20 that are disposed along the sides 34 of the mold box 32, top inserts 52, 54 are provided defining a space between a block 20 and each side of the mold box 32. The insert 52 is configured with the same complementary profile as the side 42*a* of the insert member 42 and extends between the ends 36 of the mold box 32 along one side 34, and thus forms an upper portion of the transverse profile of the bottom surface 24 of the block 20 disposed along the side of the mold 30 at the left in FIG. 2. The insert 54 is configured with the same complementary profile as the side 42*b* of the insert member 42 and extends between the ends 36 of the mold box 32 along the other side 34, and thus forms an upper portion of the transverse profile of the top surface 22 of the block 20 disposed along the side of the mold 30 at the right in FIG. 2. Top inserts 52, 54 may be formed integrally with the sides 34 of the mold box 32, as in the embodiment illustrated, or may be affixed to the interior surface of the sides 34 of the mold box 32 in any suitable fashion.

Figure 4:
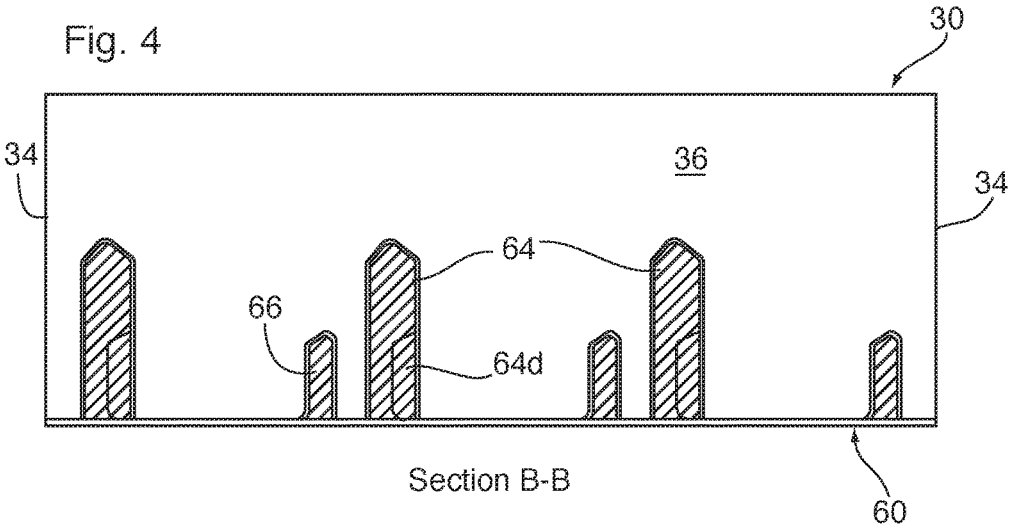
FIG. 4 is a cross-section of the mold taken along the line 4-4 in FIG. 2.

The mold floor is formed by a removable draw plate 60, for closing the bottom face 50 of the mold box 32 and containing the concrete during casting. The draw plate 60 comprises a generally planar floor 62 which spans at least the length and width of the bottom 50 of the mold box 32, to thereby seal the bottom of the mold cavity 38 sufficiently to prevent concrete from seeping out of the mold 30 under the force of gravity and compression/consolidation. Extending between the end walls 36 of the mold box 32 and projecting from the planar floor 62 into the mold cavity 38 (when the draw plate 60 is in position for casting) are bottom insert members 64 and 66. Bottom insert members 64 are configured to define a space between adjacent blocks 20, and between blocks 20 disposed at the sides of the mold 30 and the respective side wall 34, for forming the remaining portion of the transverse profile of the bottom surface 24 of a block 20, in the embodiment shown extending from the rear face 29 of the block 20 up to and including the recess 24*a*. Bottom insert members 66 are configured to define a space between adjacent blocks for forming the remaining portion of the transverse profile of the top surface 22 of a block 20, in the embodiment shown extending from the rear face 29 of the block 20 up to but not including the rib 22*a*. Thus, bottom insert members 64 and 66 form the remainder of the transverse profiles of the top and bottom surfaces 22, 24 of the interlocking block 24, as best seen in FIG. 4.

At least one end wall 36 of the mold box 32 provides openings 64*a*, 66*a* into which the bottom insert members 64, 66 are respectively received. Preferably the openings 64*a*, 66*a* closely match the profiles of the bottom insert members 64, 66, respectively, providing a seal that substantially prevents concrete from seeping out of the openings 64, 66 when the draw plate 60 is in position in the mold 30. It may in some embodiments be advantageous to provide openings 64*a*, 66*a* in both end walls 36, as in the embodiment shown (best seen in FIG. 10).

Figure 8:
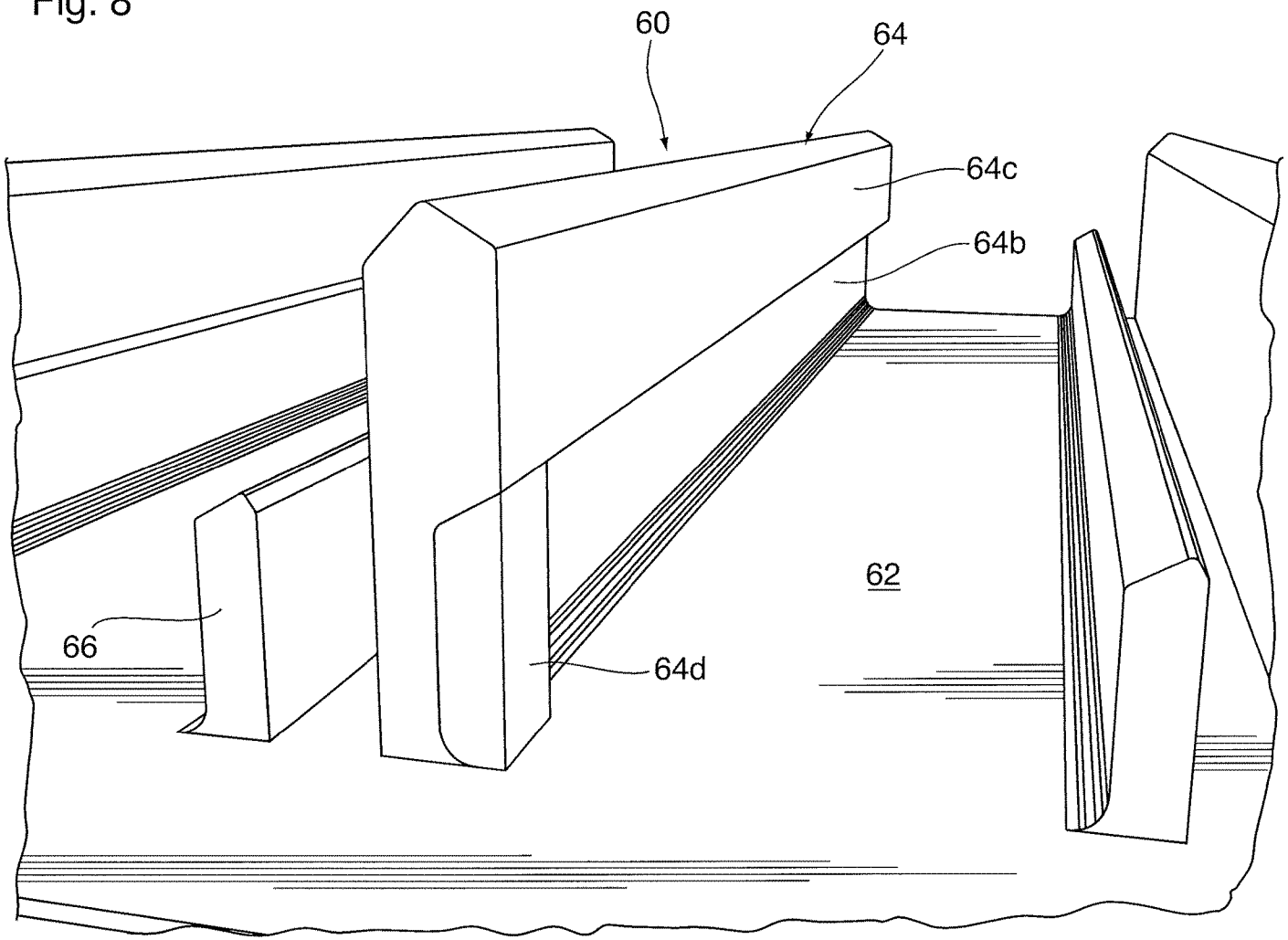
FIG. 8 is an enlarged partial perspective view of the draw plate in the mold of FIG. 2.
Figure 9:
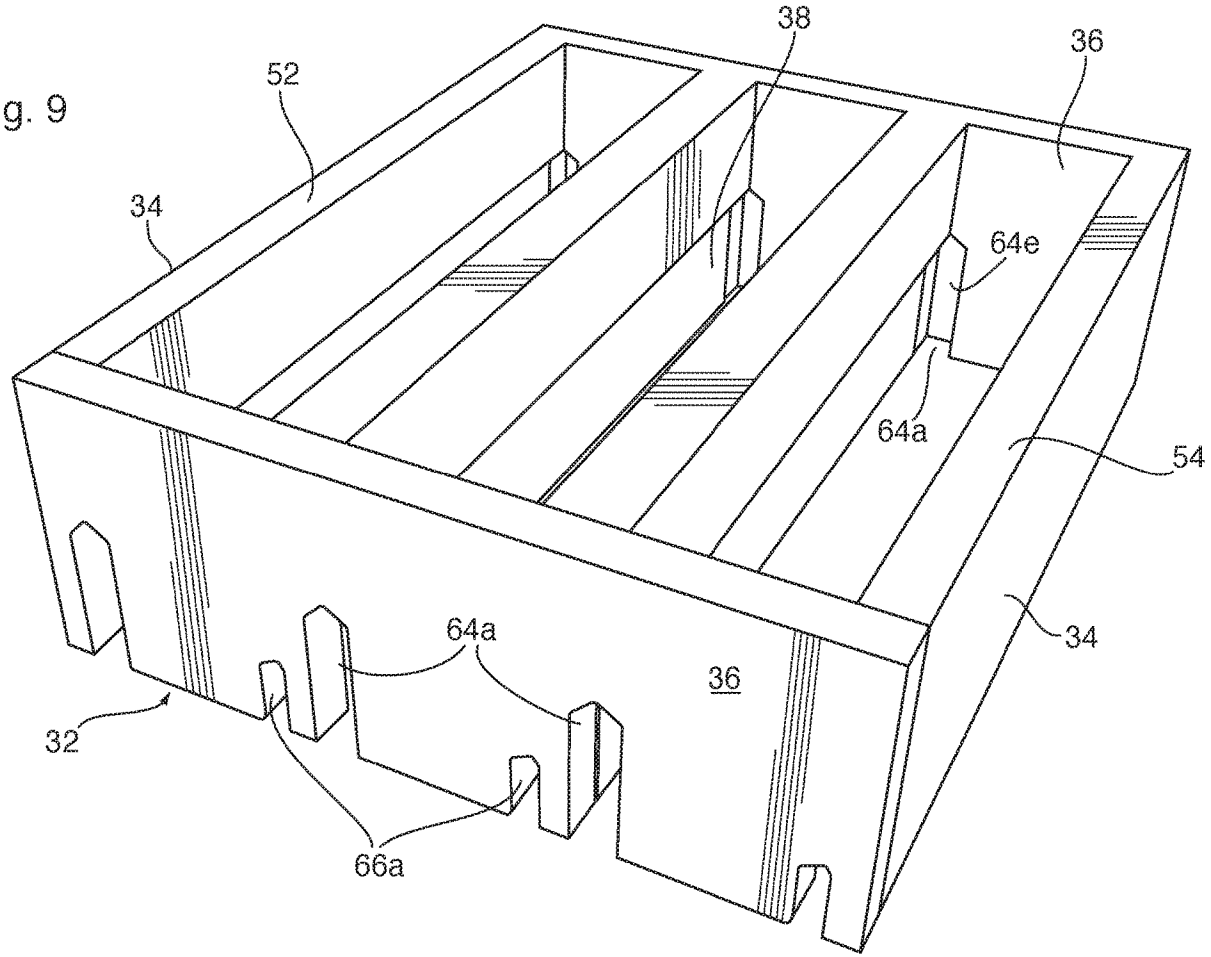
FIG. 9 is a perspective view of the mold box in the mold of FIG. 2 taken from the top-right.

As shown in FIGS. 9 and 10, at the entrance end of the mold box 32 the end wall 36 includes openings 64*a*, 66*a* that allow the mold box 32 to sit flush on the draw plate 60 without interference by bottom insert members 64, 66, so that the bottom insert members 64, 66 project into the mold cavity 38 during casting. In the preferred embodiment the mold box 32 should be capable of being lifted up off of and placed down over the draw plate 60 in a vertical direction, to facilitate an automated transition between casting cycles. However, since the bottom insert members 64 of the draw plate 60 include an undercut area 64*b*, the openings 64*a* in the end wall 36 of the mold box 32 must be as wide as the widest portion 64*c* of the bottom insert 64 (which forms the deepest part of the recess 24*a* in the block 20), so as not interfere with the raising and lowering of the mold box 32 between casting cycles. As a result, a gap is formed in the mold box end wall 36 at the undercut portion 64*b* of the profile of the bottom insert 64. In order to prevent the seepage of the concrete mix out of the entrance end wall 36 through this gap, the undercut area at the end of the bottom insert 64 that is positioned within the end wall 36 of the mold box 32 is filled, as by filler block 64*d*, which closes this gap when the draw plate 60 is in position in the mold 30 for casting, as best seen in FIG. 8. The filler block 64*d* should be formed in such a way that the concrete material does not stick to or accumulate around the filler block 64*d*, so in the preferred embodiment a radius or fillet-type transition to the filler block 64*d* is provided.

In the preferred embodiment openings 64*a*, 66*a* are provided in both end walls 36 of the mold box 32, as shown in FIG. 10, so that the insert members 64,66 intrude into the thickness of both end walls 36. Thus, in the embodiment illustrated the insert members 64 extend only through the thickness of the rear end wall 36 and no further. A plate 64*e* or other covering member is affixed to the exterior surface of the rear end wall 36 over the openings 64*a*, as shown in FIGS. 9 and 10, to contain the concrete (the small concrete protrusion that intrudes into the undercut area 64*b* of insert member 64 within the end wall thickness can be removed with a chisel or blade). In an alternative arrangement (not shown) the insert members 64 can terminate at the interior surface of the rear end wall 36, in which case no openings 64*a* would be required in the rear end wall 36, although openings 64*a* would still be advantageously provided in the front end wall 36 so that after casting the draw plate 60 can be slid horizontally out of the mold 30 while the blocks 20 are still in the mold box 32.

In a still further alternative (not shown), the openings 64*a* in the end walls 36 can be formed to match the profile of the insert members 64, including the undercut 64*a*, and the concrete will be retained within the mold cavity 38 because of the close fit of the openings 64*a* around the insert members 64. However, in this embodiment the draw plate 60 must be inserted horizontally into the mold box 32, rather than the mold box 32 being lowered vertically onto the draw plate 60, which makes automation more complex.

It will be appreciated that the insert members 42, 54, 56, 64 and 66 extend fully between the end walls 36 of the mold box 32 because the ribs 22*a* and recesses 24*a* extend fully end-to-end across the blocks 20. In embodiments where the interlocking structures do not extend fully end-to-end across the blocks 20, the insert members 42, 54, 56, 64 and 66 will only have the length necessary to form the interlocking structures.

Figure 12A:
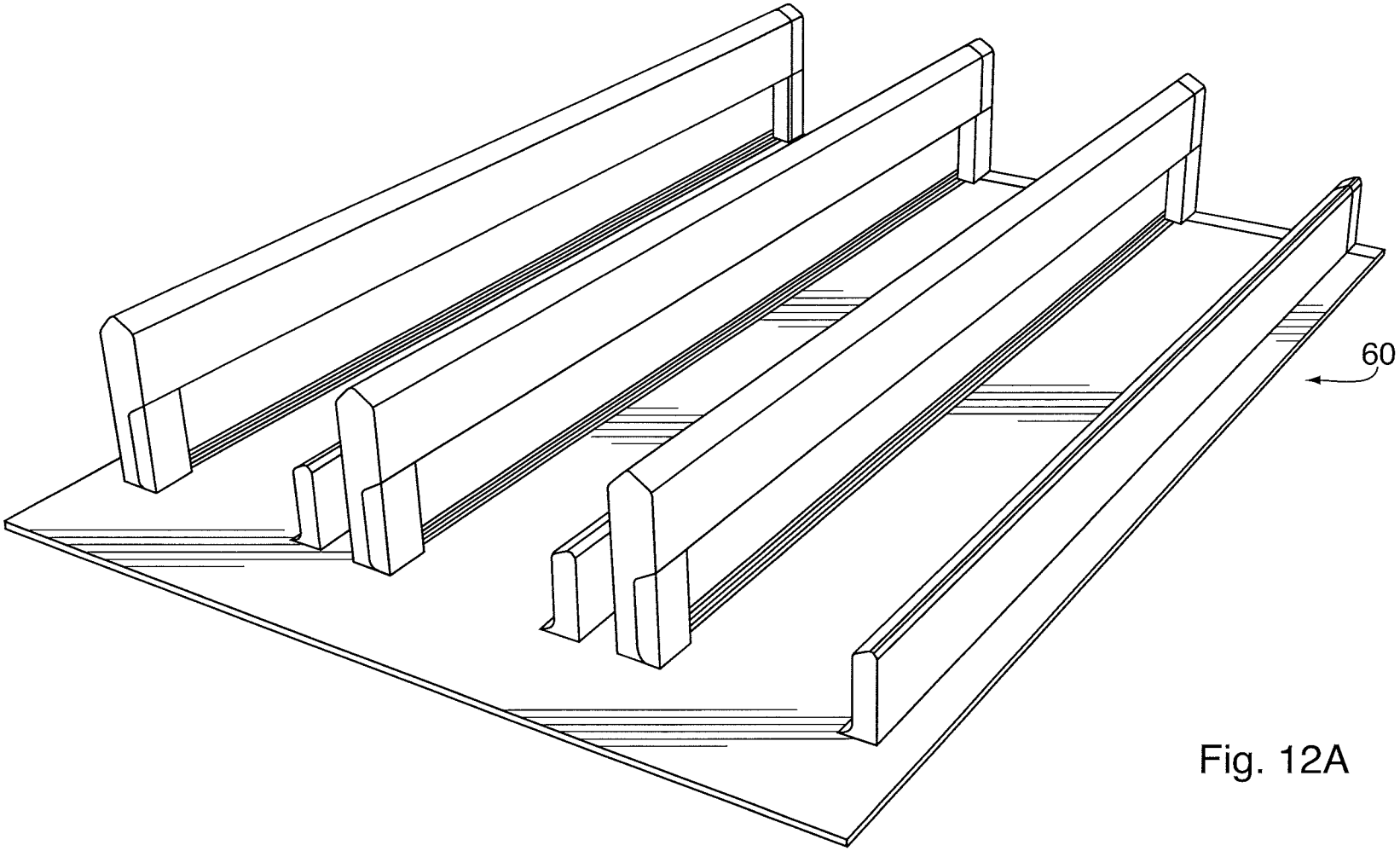
FIGS. 12A to 12H illustrate steps in the manufacture of concrete blocks using the mold of FIG. 2.
Figure 12B:
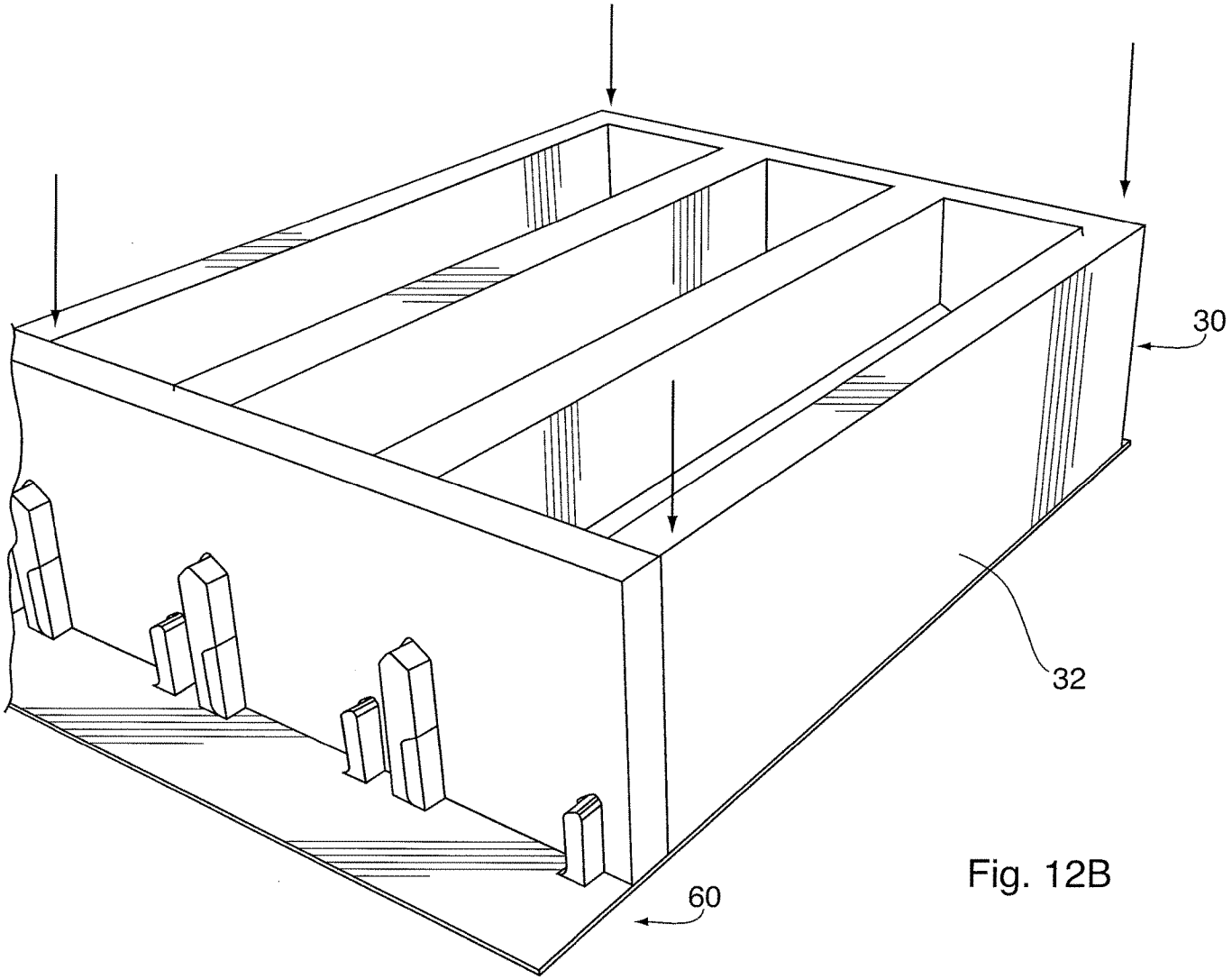
Figure 12C:
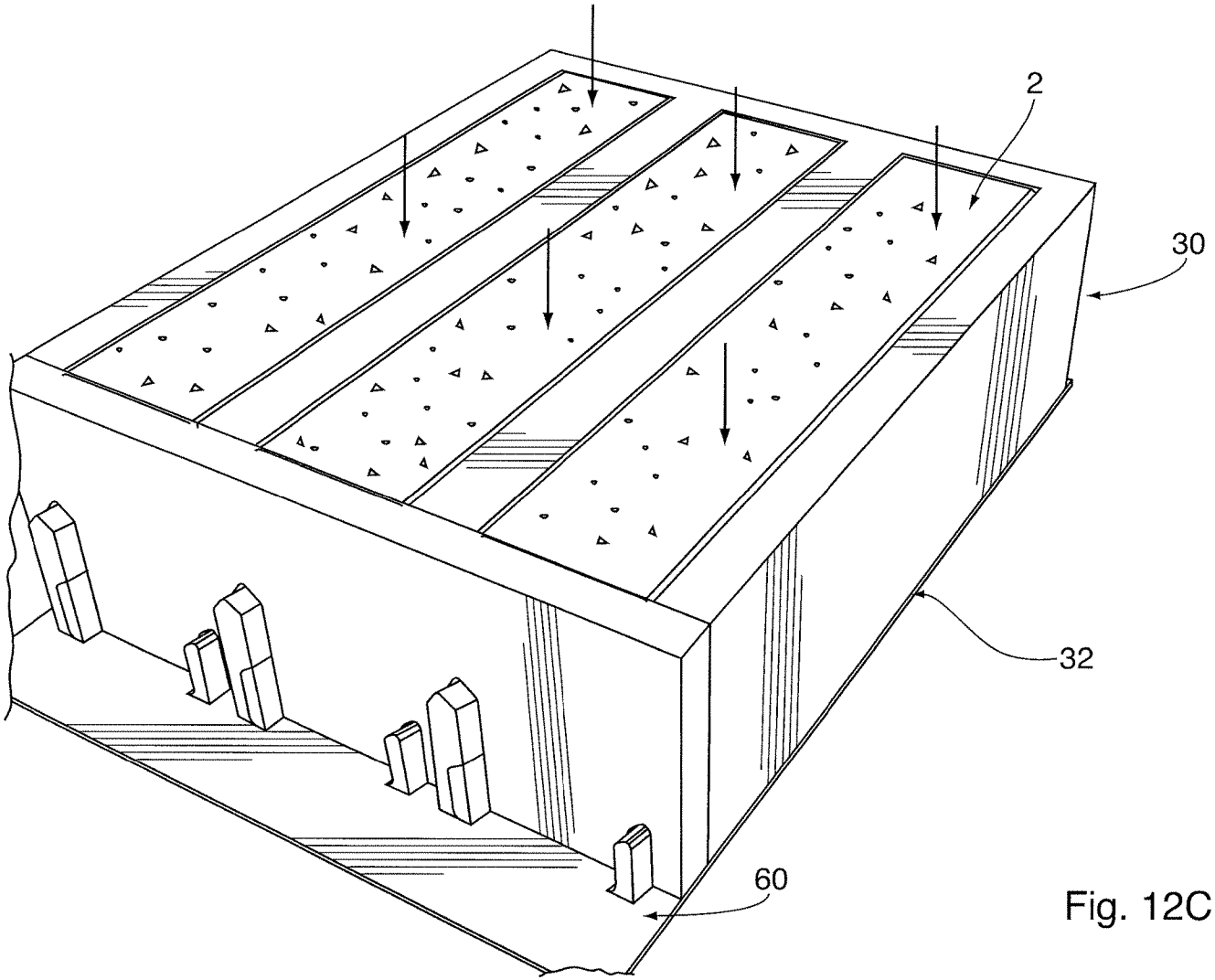
Figure 12D:
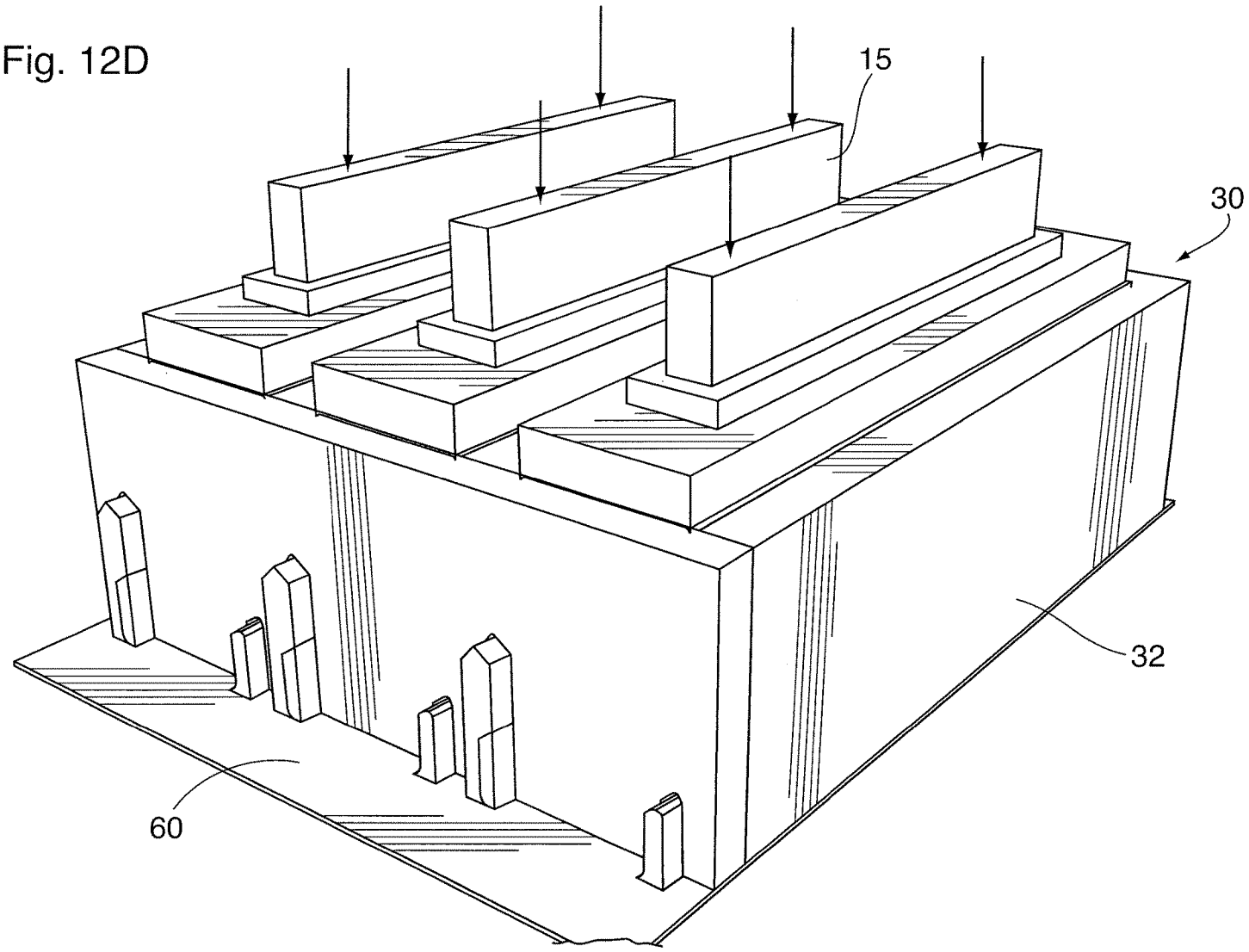

FIGS. 12A to 12H illustrate the casting cycle using a mold 30 of the invention, preferably in a generally automated process. The draw plate 60 is positioned on a riser or palette (not shown), as shown in FIG. 12A, and the mold box 32 is lowered onto the draw plate 60 by aligning bottom insert members 64, 66 with their respective openings 64*a*, 66*a* in the end walls 36 of the mold box 32 until the mold box 32 is seated on the floor 62, such that the draw plate 60 closes the bottom of the mold box 32, as shown in FIG. 12B. Concrete 2 is then fed into the mold 30, as shown in FIG. 12C, through the openings between the top insert members 42, 52 and 54. The press head 15 is activated, as shown in FIG. 12D, to consolidate the concrete and, if desired, impart a texture or profile to the exposed faces 28 of the blocks 20.

Figure 12E:
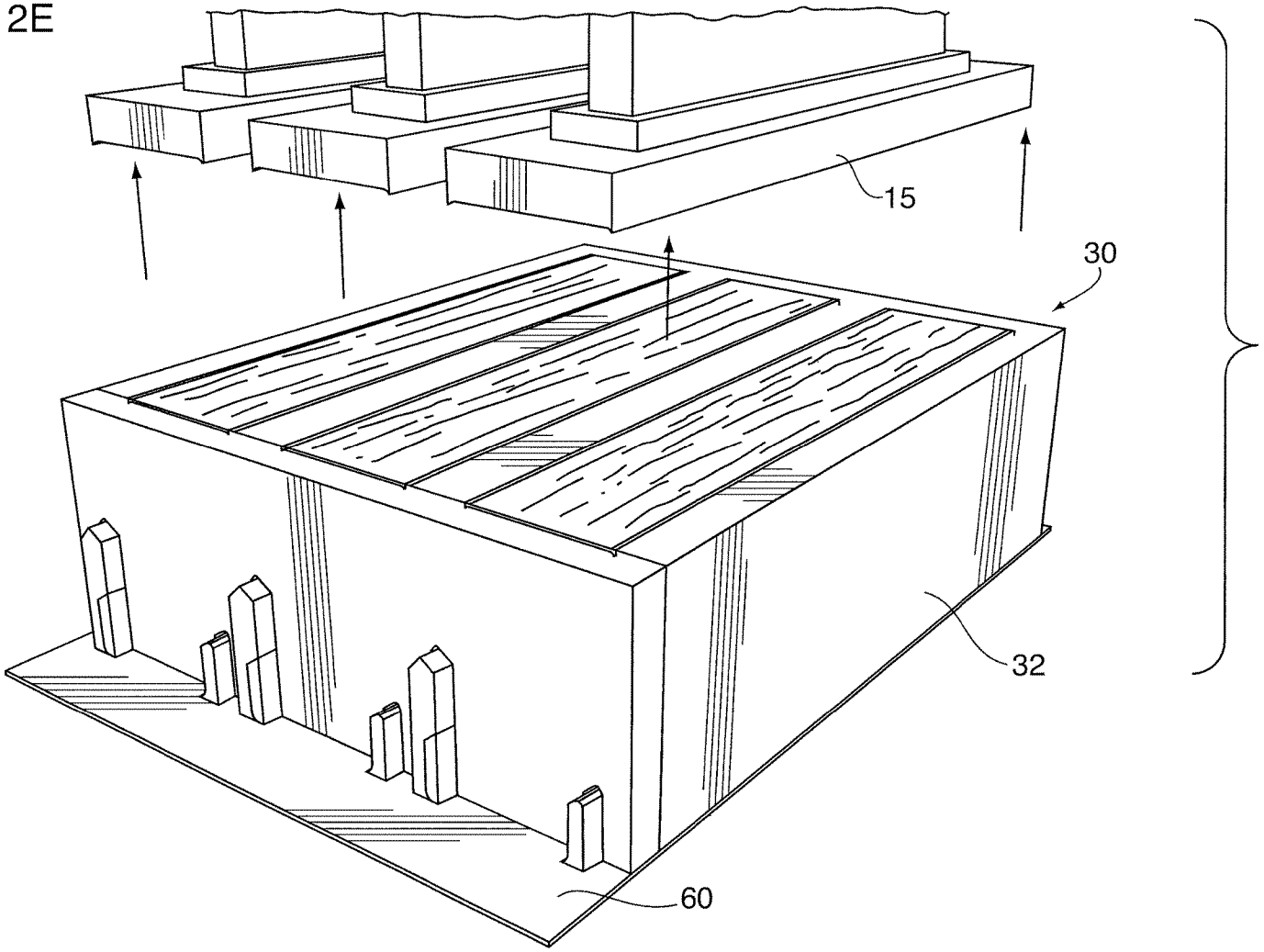
Figure 12F:
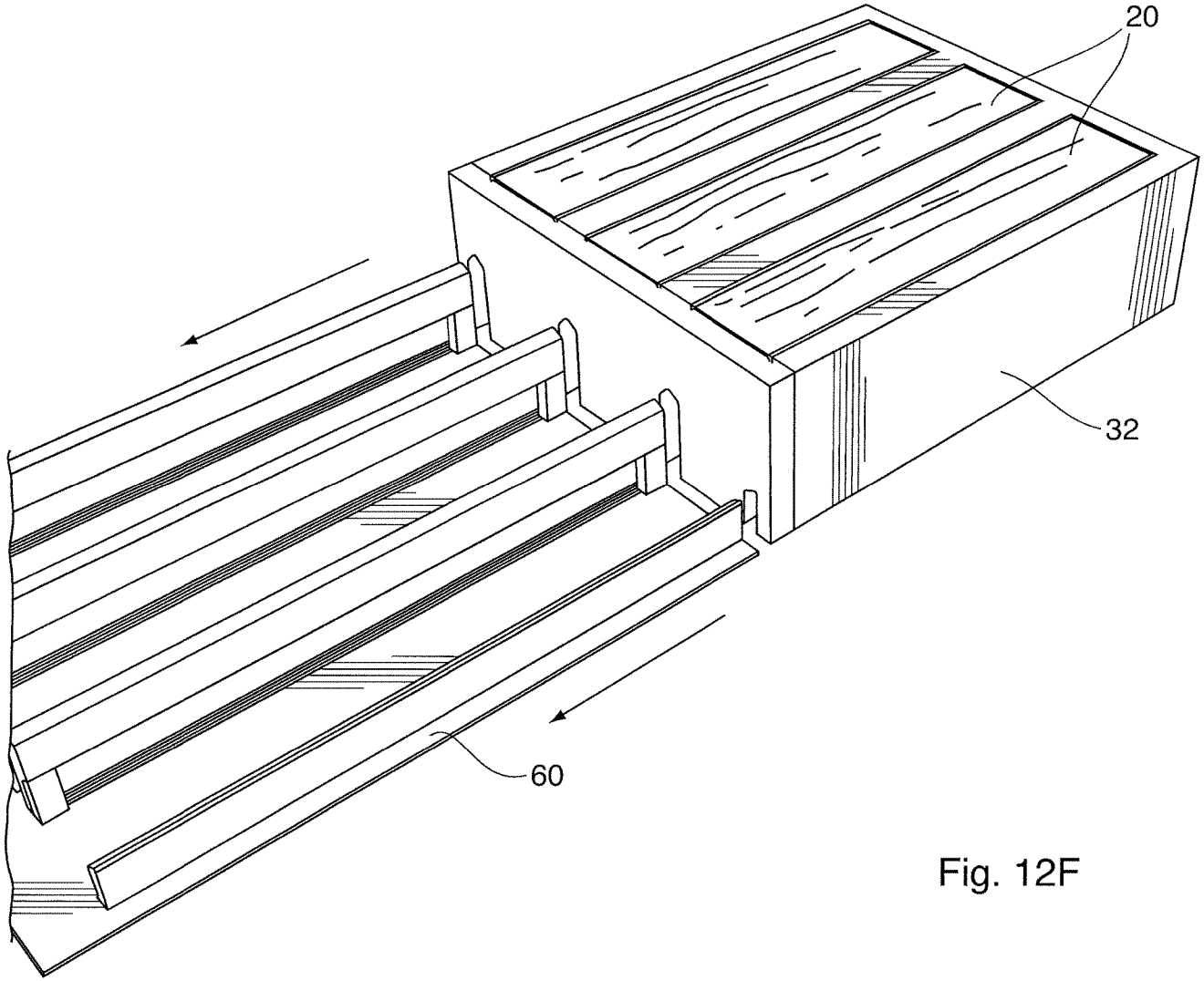

The press head 15 is retracted, as shown in FIG. 12E, and in the preferred embodiment the draw plate 60 is removed by drawing the draw plate 60 out of one end 36 of the mold box 32, as shown in FIG. 12F. Because of the uniform transverse profile of the blocks along the lateral extent of each block 20, the draw plate 60 can be removed laterally from the mold box 32 substantially unimpeded by the interlocking structures formed on the concrete blocks 20.

Figure 3:
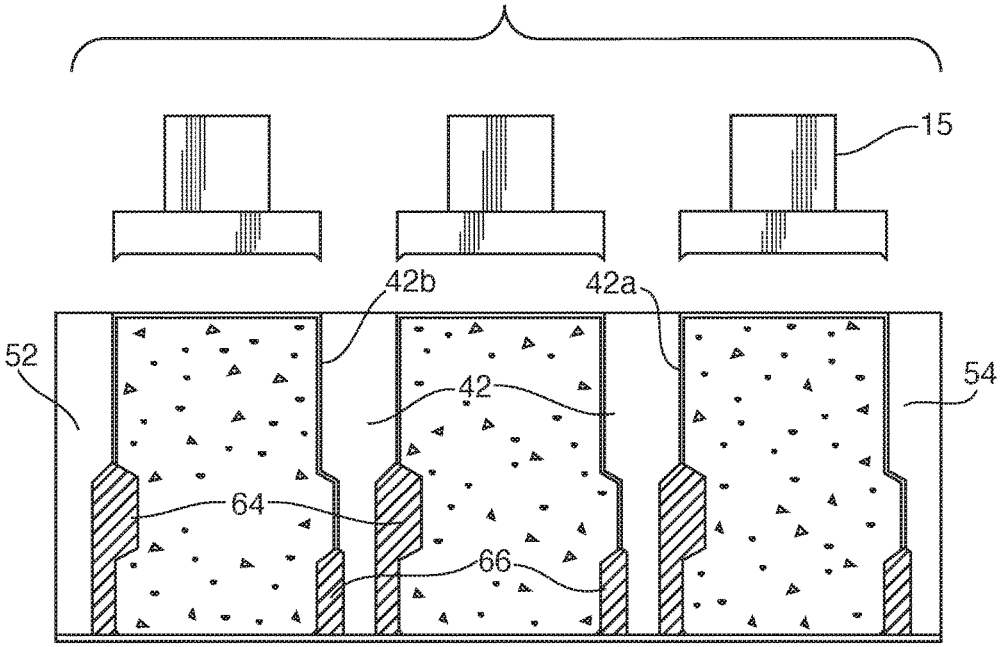
FIG. 3 is a cross-section of the mold taken along the line 3-3 in FIG. 2.
Figure 12G:
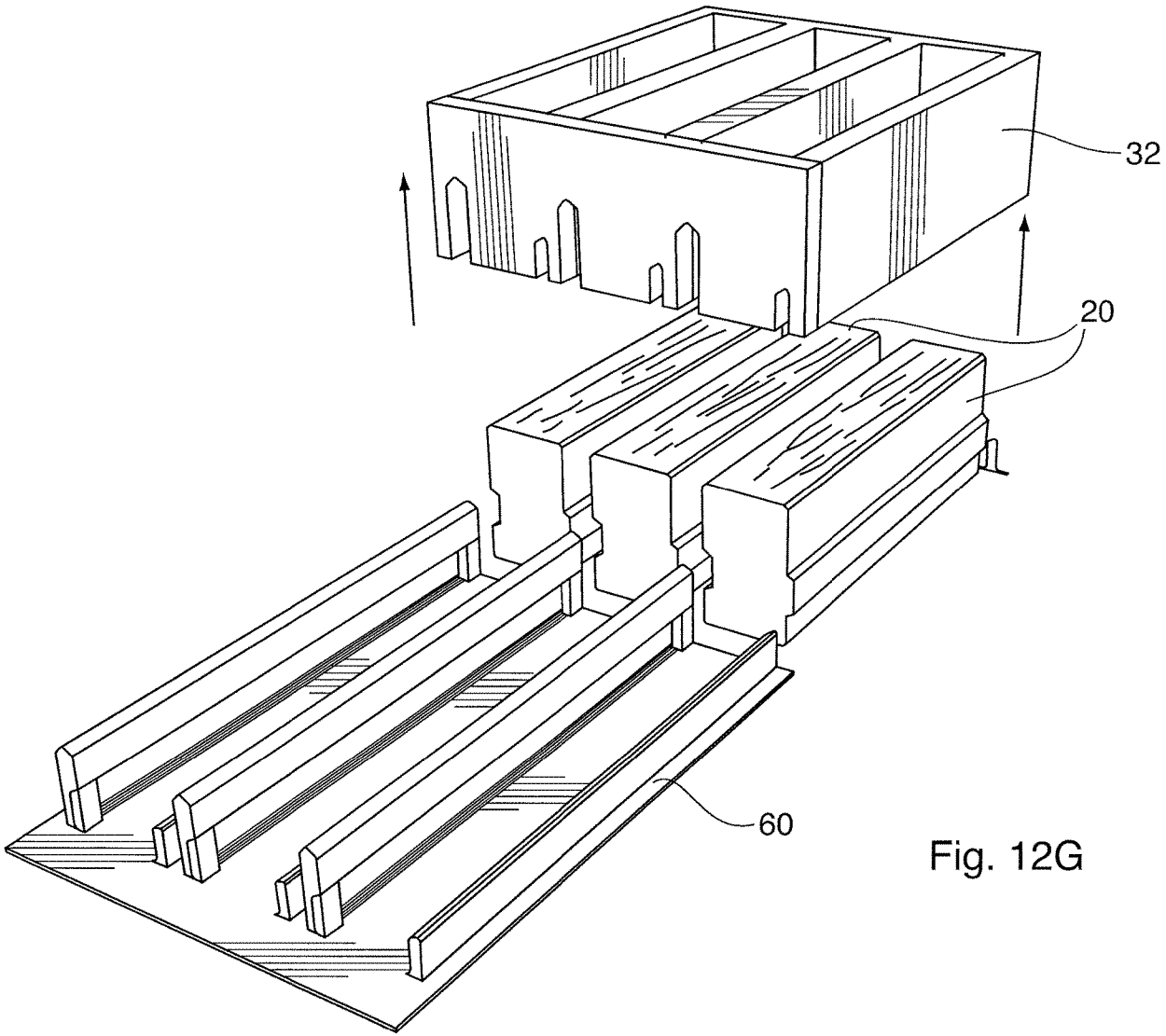

The mold box 32 is then lifted off of the newly formed blocks 20, as shown in FIG. 12G. Because there is no positive interlock between the top insert members 42, 52, or 54, and the upper portions of the transverse profiles of the blocks 20, as can be seen in FIG. 3, the mold box 32 can be lifted off of the concrete blocks 20 without obstruction. The upper portion of the transverse profile of each block 20 formed by the top insert members 42 (and inserts 52, 54) is selected so that no portion of the top 22 or bottom 24 of the block interlocks in a vertical direction with the top insert members 42, 52 or 54.

It is advantageous to slide the draw plate 60 out from under the newly formed blocks 20 while the mold box 32 is still in position. Alternatively, the mold box 32 can be lifted first and the blocks 20 held in position by other means as the draw plate 60 is drawn out from underneath the blocks.

Figure 12H:
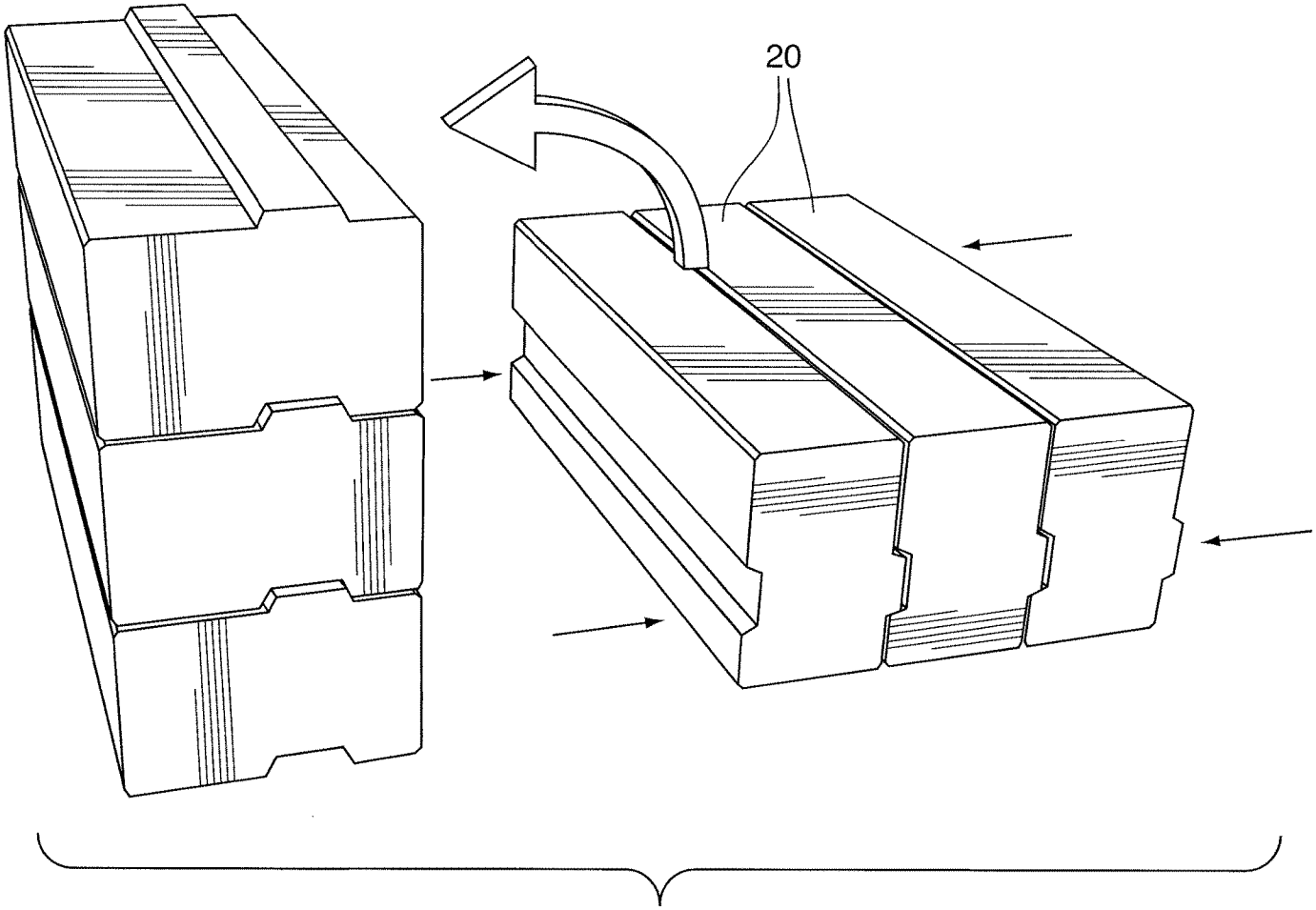
Figure 13:
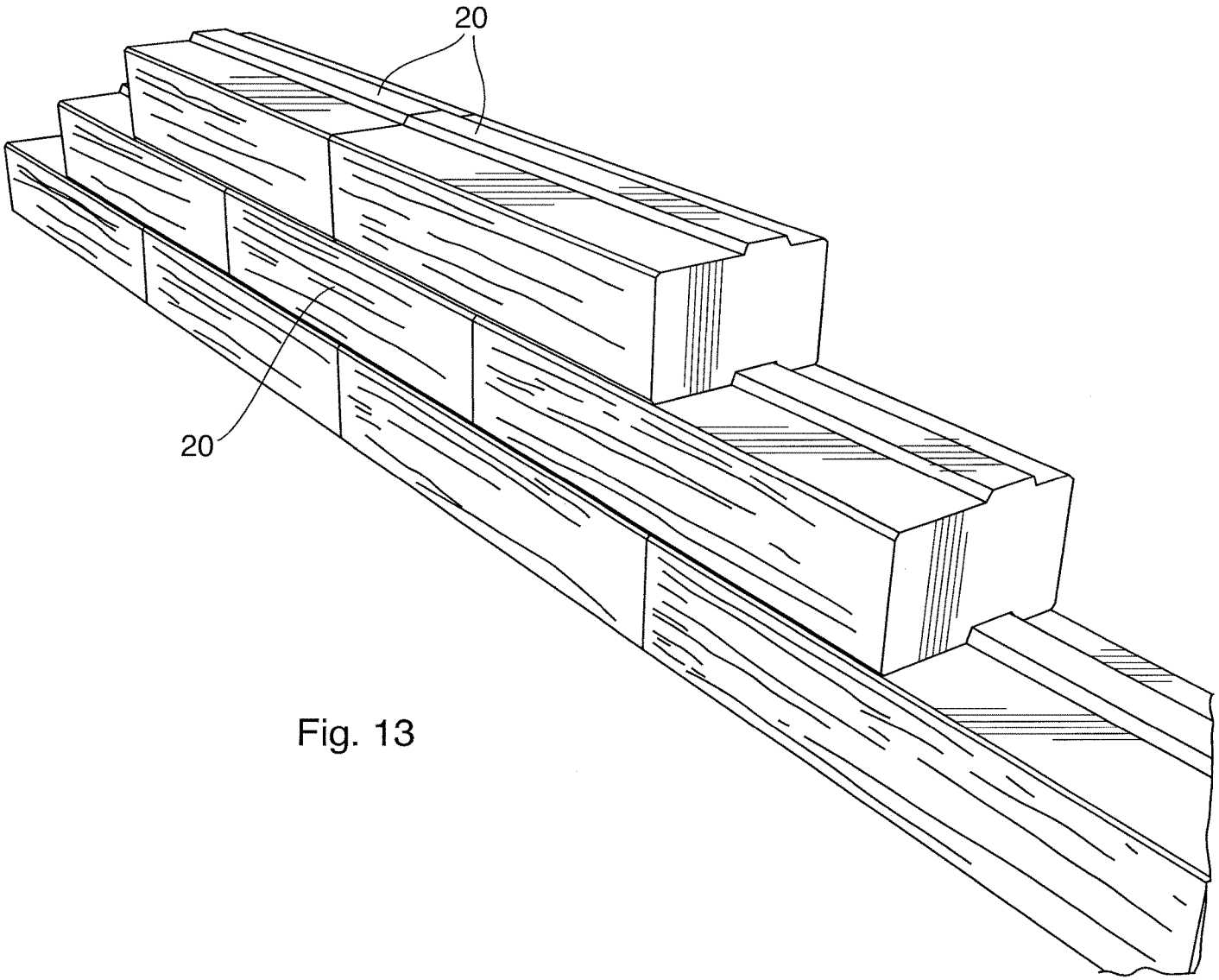
FIG. 13 is a perspective view of a retaining wall utilizing interlocking concrete blocks produced by the mold and method of the invention.

Finally, as shown in FIG. 12H, the newly formed blocks 20 are forced together and stood upright, to be placed on a skid for shipping.

The components of the mold 30 would typically be formed from steel or any other suitable material. The embodiment illustrated is dimensioned to cast three concrete blocks 20, however the mold 30 can be designed to cast fewer or more concrete blocks 20 as desired, the components of the mold 30 being provided with thicknesses suitable for withstanding the weight of the concrete without deforming. It will be appreciated that since the components of the mold box 32 and draw plate 60 combine to form parallel surfaces, increased accuracy of mold construction and manufacturing may be required.

It will be appreciated that although the blocks 20 are illustrated as oriented in the same direction in the mold 30, because of the versatility in providing profiles on the inserts 42, 52, 54, 64, 66, the blocks 20 can be oriented in the mold 30 in different directions, for example some facing rib-to-rib and others oriented rib-to-recess as shown.

A mold and method for manufacturing interlocking concrete blocks has been described. In an embodiment, the mold comprises a mold box, comprising two side walls joined to end walls to define a mold cavity, a top face, and a substantially open bottom face. Top insert members are configured to define a space between adjacent blocks, for forming a portion of the transverse profile of the top surface of one block or a portion of the transverse profile of the bottom surface of an adjacent block, or both. A removable draw plate for closing the bottom of the mold box comprises a generally planar floor and bottom insert members configured to define a space between adjacent blocks, for forming a remaining portion of the transverse profile of the top surface of one block or a remaining portion of the transverse profile of the bottom surface of an adjacent block, or both. Thus, inserts within the mold box and vertical projections from the draw plate combine to form the top and bottom surfaces of the block, making the draw plate a more important component in the formation of both the positive and negative structures of the block.

Various embodiments of the present invention having been thus described in detail by way of example, it will be apparent to those skilled in the art that variations and modifications may be made without departing from the invention. For example, although less advantageous than the preferred embodiments, the blocks 20 could be formed in the mold with their exposed faces 28 at the bottom of the mold while still providing some advantages of the invention. The invention includes all such variations and modifications as fall within the scope of the appended claims.

The invention claimed is:

1. A mold for manufacturing at least one interlocking concrete block, the at least one block having a top surface having a transverse profile comprising at least one interlocking structure projecting from or recessed into the top surface, and a bottom surface having a transverse profile comprising at least one complementary interlocking structure projecting from or recessed into the bottom surface, the mold comprising:

a mold box, comprising:

two side walls joined to end walls to define a mold cavity, a top face, and a substantially open bottom face; and top insert members configured to define a space between adjacent blocks or a space between a block and a side of the mold box, extending between the end walls of the box substantially from the top face into the mold cavity, for forming a portion of the transverse profile of the top surface of one block or a portion of the transverse profile of the bottom surface of an adjacent block or both;

and a removable draw plate for closing the bottom of the mold box, comprising:

a generally planar floor; and bottom insert members configured to define a space between adjacent blocks, or a space between a block and a side of the mold box, extending between the end walls and projecting from the floor into the mold cavity, for forming a remaining portion of the transverse profile of the top surface of one block or a remaining portion of the transverse profile of the bottom surface of an adjacent block, or both;

wherein at least one end wall of the mold box provides openings for receiving the bottom insert members, the bottom insert members can be received in and retracted from the openings in the at least one end wall of the mold box both horizontally and vertically, and some of the bottom insert members comprise an undercut surface, the undercut surface being provided with a filler block to close a gap between the end wall and the undercut surface.

2. The mold of claim 1 for manufacturing a plurality of interlocking concrete blocks.

3. The mold of claim 1 wherein the concrete blocks are provided with tongue and groove interlocking structures.

4. The mold of claim 1 comprising openings in both end walls of the mold box, wherein the bottom insert members extend through both end walls when the draw plate is in position in the mold.

5. The mold of claim 1 wherein at least one top insert member is formed integrally with at least one of the side walls.

6. The mold of claim 3 wherein the top insert members extend substantially between the end walls of the mold box, for manufacturing concrete blocks wherein the tongue and groove interlocking structures extend substantially between the ends of the concrete blocks.

7. A system for manufacturing at least one interlocking concrete block in the mold of claim 1 wherein an exposed face of the at least one concrete block is generally flush with the top face of the mold, comprising a press head for imparting a profile or texture, or both, to the exposed face.

* * * * *